US011254139B2

(12) United States Patent
Leiser et al.

(10) Patent No.: US 11,254,139 B2
(45) Date of Patent: Feb. 22, 2022

(54) FLUIDIC VALVES FORMED IN A SUB-ASSEMBLY

(71) Applicant: Hewlett-Packard Development Company, L.P., Spring, TX (US)

(72) Inventors: Judson M. Leiser, Corvallis, OR (US); Mark A. Devries, Corvallis, OR (US); James D. Hankins, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/765,047

(22) PCT Filed: Jul. 13, 2018

(86) PCT No.: PCT/US2018/042001
§ 371 (c)(1),
(2) Date: May 18, 2020

(87) PCT Pub. No.: WO2020/013850
PCT Pub. Date: Jan. 16, 2020

(65) Prior Publication Data

US 2020/0398581 A1 Dec. 24, 2020

(51) Int. Cl.
*B41J 2/175* (2006.01)

(52) U.S. Cl.
CPC ..... *B41J 2/17596* (2013.01); *B41J 2/1752* (2013.01); *B41J 2/17509* (2013.01); *B41J 2/17513* (2013.01); *B41J 2/17523* (2013.01); *B41J 2002/17516* (2013.01)

(58) Field of Classification Search
CPC .... B41J 2/175; B41J 2/17509; B41J 2/17513; B41J 2/1752; B41J 2/17523; B41J 2/17596; B41J 2002/17516
See application file for complete search history.

(56) References Cited

U.S. PATENT DOCUMENTS 5,734,401 A * 3/1998 Clark ..... B41J 2/17596 347/86
6,172,694 B1 1/2001 Droege et al.
6,322,207 B1 11/2001 Hall et al.
(Continued)

FOREIGN PATENT DOCUMENTS

CN 1143018 2/1997
CN 202782176 3/2013
(Continued)

*Primary Examiner* — Anh T Vo
(74) *Attorney, Agent, or Firm* — Hanley Flight & Zimmerman LLC

(57) ABSTRACT

A print liquid supply sub-assembly, the print liquid supply sub-assembly to connect to a printer to provide a print liquid to the printer may include a print liquid output to connect to a print liquid input of the printer; a first fluidic channel upstream of the print liquid output comprising a first fluidic valve to prevent the print liquid from entering a supply container upstream of the first fluidic valve; and a second fluidic channel upstream of the print liquid output fluidically coupled to the first fluidic channel comprising a second fluidic valve to selectively prevent the fluid from passing out of the supply container downstream from the second fluidic valve.

22 Claims, 24 Drawing Sheets

(56) References Cited

U.S. PATENT DOCUMENTS

| | | | | |
|---|---|---|---|---|
| 6,443,560 | B1 * | 9/2002 | Okano | B41J 2/06 347/55 |
| 6,612,690 | B1 | 9/2003 | Wallace et al. | |
| 6,698,870 | B2 | 3/2004 | Gunther | |
| 6,945,640 | B2 | 9/2005 | Cheek | |
| 7,147,310 | B2 * | 12/2006 | Steinmetz | B41J 2/1752 347/86 |
| 7,188,918 | B2 * | 3/2007 | Childers | B41J 2/17509 347/19 |
| 7,618,135 | B2 | 11/2009 | Stathem et al. | |
| 8,474,930 | B2 | 7/2013 | Rasmussen | |
| 8,529,030 | B2 | 9/2013 | McCracken et al. | |
| 8,696,080 | B2 | 4/2014 | Cerro et al. | |
| 8,845,083 | B2 | 9/2014 | Lucas et al. | |
| 9,056,484 | B2 | 6/2015 | Ito et al. | |
| 9,321,275 | B2 | 4/2016 | Gonzales et al. | |
| 2001/0022603 | A1 | 9/2001 | Eida | |
| 2003/0202058 | A1 | 10/2003 | Barinaga | |
| 2004/0056934 | A1 | 3/2004 | Seino | |
| 2012/0327156 | A1 * | 12/2012 | Aruga | B41J 2/1707 347/20 |
| 2013/0050356 | A1 | 2/2013 | Stathem et al. | |
| 2013/0136522 | A1 | 5/2013 | Hirano et al. | |
| 2016/0207324 | A1 | 7/2016 | Gonzales et al. | |

FOREIGN PATENT DOCUMENTS

| | | | |
|---|---|---|---|
| CN | 103171294 | | 6/2013 |
| CN | 104070821 | | 10/2014 |
| CN | 106604824 | | 4/2017 |
| CN | 107073946 | | 8/2017 |
| CN | 107206790 | | 9/2017 |
| EP | 0799702 | | 9/2003 |
| EP | 1287999 | B1 | 2/2008 |
| EP | 1464502 | B1 | 12/2011 |
| JP | S61175045 | | 8/1986 |
| WO | WO-2010134905 | A1 | 11/2010 |

* cited by examiner

FLUIDIC VALVES FORMED IN A SUB-ASSEMBLY

RELATED APPLICATION

This patent arises from the U.S. national stage of International Patent Application Serial No. PCT/US18/042001, having a filing date of Jul. 13, 2018. International Patent Applications Serial No. PCT/US18/042001 is hereby incorporated by reference in its entirety.

BACKGROUND

Printing devices operate to dispense a liquid onto a surface of a substrate. In some examples, these printing devices may include two-dimensional (2D) and three-dimensional (3D) printing devices. In the context of a 2D printing device, a liquid such as an ink may be deposited onto the surface of the substrate. In the context of a 3D printing device, an additive manufacturing liquid may be dispensed onto the surface of the substrate in order to build up a 3D object during an additive manufacturing process. In these examples, the print liquid is supplied to such printing devices from a reservoir or other supply. The print liquid reservoir holds a volume of print liquid that is passed to a liquid deposition device and ultimately deposited on a surface.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
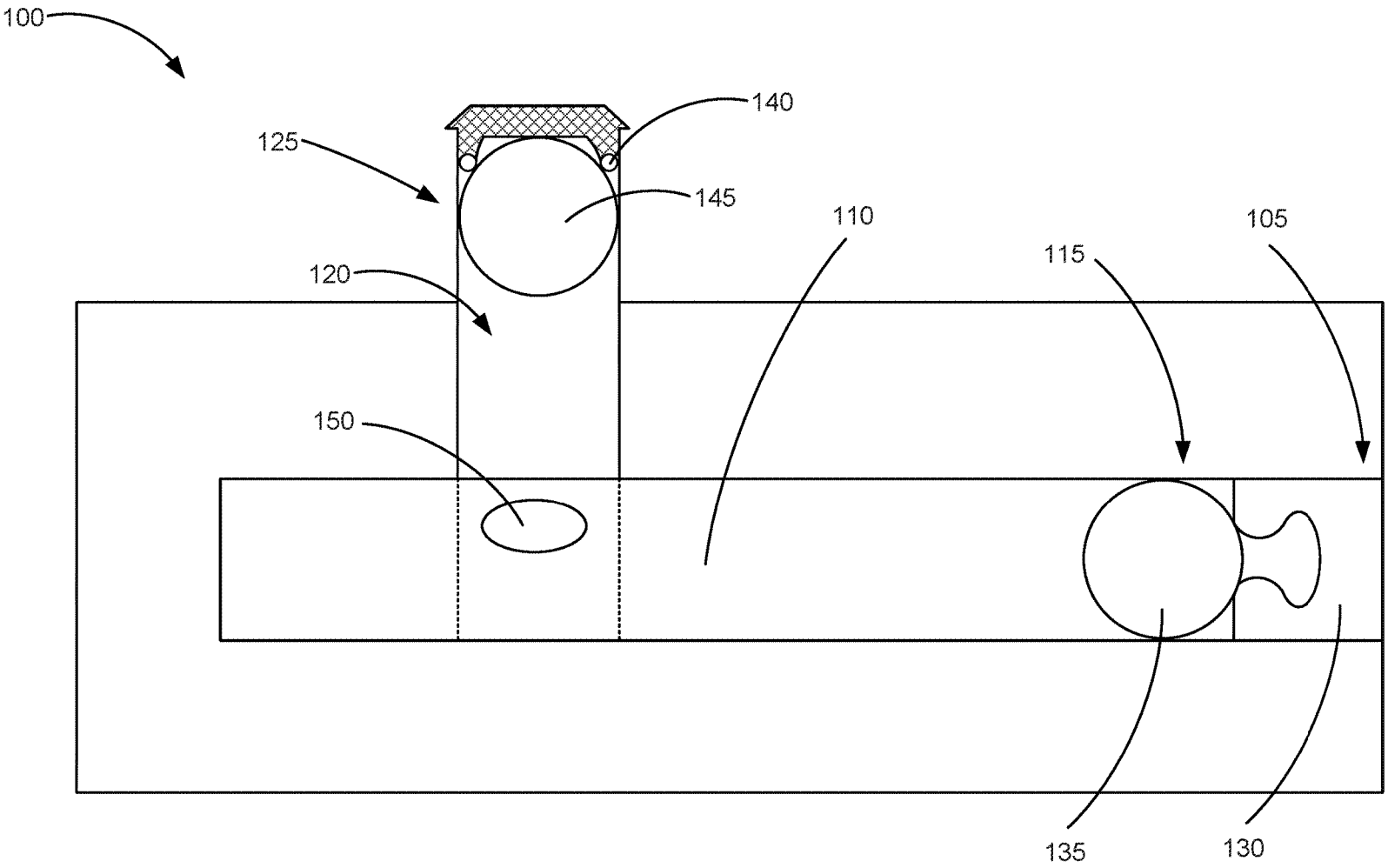
FIG. 1 is a diagrammatic view of a print liquid supply sub-assembly (100) to connect a printer to provide a print liquid to the printer according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Fluids such as printing fluids in a printing device and/or an additive manufacturing liquid in 3D printing devices are supplied to a deposition device from liquid supplies. Such liquid supplies come in many forms. For example, one such liquid supply is a pliable reservoir. Pliable reservoirs are simple in the manner in which they are made as well as their low cost. However, pliable reservoirs themselves are difficult to handle and couple to an ejection device. For example, it may be difficult for a user to physically manipulate a pliable reservoir into place within a printing device due to a lack of rigid structure around the pliable reservoir.

In examples described herein, the pliable reservoirs are disposed within a container, carton, box, or other similar structure. The container provides a structure that is relatively easier to be handled by a user. That is, a user can more easily handle a rigid container than a pliable reservoir alone. As a specific example, over the course of time, the liquid in a liquid supply is depleted such that the liquid supply is to be replaced by a new supply. Accordingly, ease of handling makes the replacement of liquid supplies more facile and leads to a more satisfactory consumer experience. Pliable containment reservoirs disposed within a rigid container may be, in some examples, referred to as bag-in-box supplies or bag-in-box liquid supplies. Such bag-in-box supplies thus provide easy handling along with simple and cost-effective manufacturing.

While the bag-in-box supplies provide certain characteristics that may further increase their utility and efficacy, in order to impart proper functionality of a printing device, a fluid-tight path is to be established between the reservoir and the printing device. To establish such a path, alignment between the reservoir and the ejection device components that receive the liquid from the reservoir may be formed. Due to the flimsy nature of pliable reservoirs, it may be difficult to ensure a proper alignment between the reservoir and the ejection device.

Accordingly, the present specification describes a print liquid reservoir and bag-in-box print liquid supply that creates a structurally rigid interface between a spout of the containment reservoir and an ejection system. That is, the present system locates, and secures, a spout of the reservoir in a predetermined location. Being thus secured, the spout through which print liquid passes from the containment reservoir to the ejection device should not rotate, flex or translate relative to the rigid container, but will remain stationary relative to the container. Affixing the spout in this fashion ensures that the spout will remain solid through installation and use.

The present specification describes a print liquid supply sub-assembly. In any of the examples presented herein, the print liquid supply sub-assembly may connect to a printer to provide a print liquid to the printer. The print liquid supply sub-assembly may include, in any of the examples presented herein, a print liquid output to connect to a print liquid input of the printer. In any of the examples presented herein, the print liquid supply sub-assembly may include a first fluidic channel upstream of the print liquid output. In any of the examples presented herein, the first fluidic channel may include a first fluidic valve to prevent the print liquid from entering a supply container upstream of the first fluidic valve. The print liquid supply sub-assembly, in any of the examples presented herein, may include a second fluidic channel upstream of the print liquid output. In any of the examples presented herein, the second fluidic channel may be fluidically coupled to the first fluidic channel. The second fluidic channel of the print liquid supply sub-assembly may, in any of the examples presented herein, include a second fluidic valve to selectively prevent the fluid from passing out of the supply container downstream from the second fluidic valve.

In any of the examples presented herein, the first fluidic channel and second fluidic channel of the print liquid supply sub-assembly may be arranged at an angle with respect to one another. In any of the examples presented herein, the first and second fluidic channels are perpendicular with respect to one another. In any of the examples presented herein, the second fluidic channel is offset from the first fluidic channel.

In any of the examples presented herein, the first fluidic valve comprises a first check valve ball and a seal to prevent flow of fluid past the first check valve ball and into the supply container. In any of the examples presented herein, the fluidic valve comprises a spring to force the first check valve ball against the seal.

In any of the examples presented herein, the second fluidic valve of the print liquid supply sub-assembly may include a second check valve ball and septum to prevent the fluid from passing out of the supply container downstream from the second fluidic valve. In any of the examples presented herein, the second fluidic valve comprises a spring to force the second check valve ball against a selectively closable hole formed in the septum In any of the examples presented herein, the second fluid channel comprises a number of ribs through which a fluid may flow past the second check valve ball when the second check valve ball is pushed into the second fluid channel by a fluid needle. In any of the examples presented herein, an interface between the first fluidic channel and second fluidic channel is located at a distance along an off-center length of the second fluid channel.

The present specification also describes a replaceable printing fluid supply. In any of the examples presented herein, the replaceable printing fluid supply may include a container to hold a volume of printing fluid. In any of the examples presented herein, the replaceable printing fluid supply may include a fluidic interface. In any of the examples presented herein, the fluidic interface may include a first fluidic channel fluidically coupled to the container. In any of the examples presented herein, the fluidic interface may include a second fluidic channel fluidically coupled to the first fluidic channel. In any of the examples presented herein, the second fluidic channel includes a first fluidic valve to selectively prevent the printing fluid from passing out of the container downstream from the first fluidic valve. In any of the examples presented herein, the first fluidic channel and second fluidic channel are offset from a horizontal middle of the fluidic interface.

In any of the examples presented herein, the first fluidic channel and second fluidic channel of the replaceable printing fluid supply are offset from each other. In any of the examples presented herein, the offset of the first fluidic channel and second fluidic channel from the middle of the fluidic interface is equal to the sum of the radii of each of the channels. In any of the examples presented herein, the first fluidic channel comprises a second fluidic valve and wherein the second fluidic valve comprises a first ball to prevent the backflow into the container by being forced into a collar formed on a proximal end of the first fluidic channel closest to the container. In any of the examples presented herein, the second fluidic valve comprises a spring to force the ball into the collar. In any of the examples presented herein, the replaceable printing fluid supply may include a gasket placed intermediate to the collar and ball to selectively seal the fluid in the second fluidic valve.

In any of the examples presented herein, the second fluidic channel may include a septum. In any of the examples presented herein, the fluidic valve comprises a spring and ball, the spring forcing the ball against a resealable hole formed in the septum. In any of the examples presented herein, a surface of the septum between the ball and the septum is concave.

The present specification also describes a bag-in-box fluid supply. In any of the examples presented herein, the bag-in-box fluid supply may include a pliable fluid containment bag to hold a supply of printing fluid. In any of the examples presented herein, the bag-in-box fluid supply may include a carton in which the pliable fluid containment bag is disposed. In any of the examples presented herein, the bag-in-box fluid supply may include a fluid path formed within the bag in box printing fluid supply. In any of the examples presented herein, the fluid path may include a first fluidic channel comprising a ball and gasket to prevent a fluid from entering the pliable fluid containment bag placed upstream of the first fluidic channel. In any of the examples presented herein, the fluid path may include a second fluidic channel comprising a ball and septum to prevent the fluid from passing out of the bag in box printing fluid supply via the second fluidic channel. In any of the examples presented herein, the first fluidic channel and second fluidic channel are fluidically coupled to one another.

In any of the examples presented herein, the first fluidic channel and the second fluidic channel are formed within a cap exterior of the carton and fluidically coupled to the pliable fluid containment bag. In any of the examples presented herein, the second fluidic channel comprises a spring and ball, the spring to apply force against the ball to cause the ball to push against the resealable hole in the septum.

In any of the examples presented herein, the septum comprises a resealable hole therein to selectively receive a printing fluid supply. In any of the examples presented herein, the second fluidic channel is offset from the first fluidic channel and wherein an interface between the first fluidic channel and second fluidic channel is located at a distance along an off-center length of the second fluid channel.

As used in the present specification and in the appended claims, the term "print liquid supply" refers to a device that holds a print fluid. For example, the print liquid supply may be a pliable reservoir. Accordingly, a print liquid supply container refers to a carton or other housing for the print liquid supply. For example, the print liquid supply container may be a cardboard box in which the pliable containment reservoir is disposed.

Still further, as used in the present specification and in the appended claims, the term "print fluid" refers to any type of fluid deposited by a printing device and can include, for example, printing ink or an additive manufacturing fabrication agent. Still further, as used in the present specification and in the appended claims, the term "fabrication agent" refers to any number of agents that are deposited and includes for example a fusing agent, an inhibitor agent, a binding agent, a coloring agent, and/or a material delivery agent. A material delivery agent refers to a liquid carrier that includes suspended particles of at least one material used in the additive manufacturing process.

Turning now to the figures, FIG. 1 is a diagrammatic view of a print liquid supply sub-assembly (100) to connect a printer to provide a print liquid to the printer according to an example of the principles described herein. In any of the examples presented herein, the print liquid supply sub-assembly (100) may include a print liquid output (105), a first fluidic channel (110) upstream of the print liquid output (105), a first fluidic valve (115) within the first fluidic channel (110), a second fluidic channel (120) upstream of the print liquid output (105) fluidically coupled to the first fluidic channel (110), and a second fluidic valve (125) within the second fluidic channel (120).

The print liquid output (105) may include any device that fluidically couples the print liquid supply sub-assembly (100) to a printing device interface in order to provide a print liquid to the printing device. In in any of the examples presented herein, the print liquid output (105) may include a terminal end of the first fluidic channel (110) having a septum (130). The septum (130) may include a hole defined therein through which a needle of the printer may be inserted. In any example presented herein, the septum (130) may have a concave shape where a ball (135) interfaces with the septum (130). In other examples, the surface of the septum (130) where the ball (135) meets the septum (130) may conform to the ball (135).

The second fluidic channel (120) may further include a second fluidic valve (125). The second fluidic valve (125) may be any type of valve that may selectively allow the print liquid to pass to and/or through the print liquid output (105). In an example, the second fluidic valve (125) may selectively allow the print liquid to pass to and/or through the print liquid output (105) when the first fluidic valve (115) interacts with a needle of the printing device. In the example shown in FIG. 1, the second fluidic valve (125) includes a ball (145).

In any example presented herein, the needle of the printing device may be passed through a hole defined in the septum (130) and allowed to push the ball (135) away from the septum (130). In an example, the interior surface of the first fluidic channel (110) may include bypass channels whose ridges hold the ball (135) above valleys formed by the bypass channels. This may allow the ball (135) to simultaneously be held in a longitudinally central location within the first fluidic channel (110) while fluid is allowed to pass past the ball (135) and to the needle described herein.

The print liquid supply sub-assembly (100) may, in any of the examples presented herein, include a first fluidic channel (110). In any of the examples presented herein, the first fluidic channel (110) may be at an angle relative to the second fluidic channel (120). In an example, the angle 90 degrees with the first fluidic channel (110) being orthogonal or perpendicular to the second fluidic channel (120). In any of the examples presented herein, the first (110) and second fluidic channels (120) may be offset relative to each other. In any of the examples presented herein, the first (110) and second fluidic channels (120) may be placed at an angle relative to each other. In an example, this angle is orthogonal or perpendicular. In any of the examples presented herein, the first (110) and second fluidic channels (120) may be offset from a central plane of the print liquid supply sub-assembly (100).

The second fluidic channel (120) may include a second fluidic valve (125). The second fluidic valve (125) may, in any of the examples presented herein, include a gasket (140) and a ball (145). The second fluidic valve (125) may prevent a print liquid from entering a supply container upstream of the second fluidic valve (125). In an example, the second fluidic valve (125) may prevent a backflow of print fluid from the first fluidic channel (110) and second fluidic valve (125) to the supply container from occurring. In an example, pressures realized within the second fluidic valve (125) may cause the ball (145) to abut the gasket (140) thereby preventing the backflow into the container. In an example, a spring may be included within the second fluidic valve (125) downstream of the second fluidic valve (125) that applies a force against the ball (145) so that the ball (145) may be selectively contacting the gasket (140). In this example, a negative pressure within the second fluidic valve (125) and/or first fluidic channel (110) provided by a pump of the printing device may cause the force of the spring to be overcome thereby pulling the ball (145) away from the gasket (140).

Although specific examples describe a specific type of valve being used for either the first fluidic valve (115) and second fluidic valve (125), any suitable valve may be used and the present specification contemplates the use of these other types of valves. Example valves may contain a gasket, a ball, and/or a plug, among others. Other types of examples valves may include a butterfly valve, a plug valve, and a cone valve, among others. Although the present specification uses the term "fluidic valves," the term check valves may also be used to describe the first fluidic valve (115) and second fluidic valve (125) herein.

In an example, the first (110) and second fluidic channels (120) are offset with respect to each other. The offset between the first (110) and second fluidic channels (120) is equal to the diameter of either of the first (110) and second fluidic channels (120). In an example, the offset between the first (110) and second fluidic channels (120) is equal to the sum of the cross-sectional radii of both of the first (110) and second fluidic channels (120). In any example presented herein, the offset between the first (110) and second fluidic channels (120) is a horizontal offset: the horizontal direction of the offset being defined by a longitudinal axis of the second fluidic channel (120) and running from a first end of the second fluidic channel (125) to a window (150) formed between an interface of the first fluidic channel (110) and the second fluidic channel (120).

In any of the examples presented herein, the interface between the first fluidic channel (110) and second fluidic channel (120) may include a window (150) where walls of the first fluidic channel (110) and second fluidic channel (120) meet. This window (150) may be any size based on the degree to which the first fluidic channel (110) and second fluidic channel (120) overlap each other.

Figure 2:
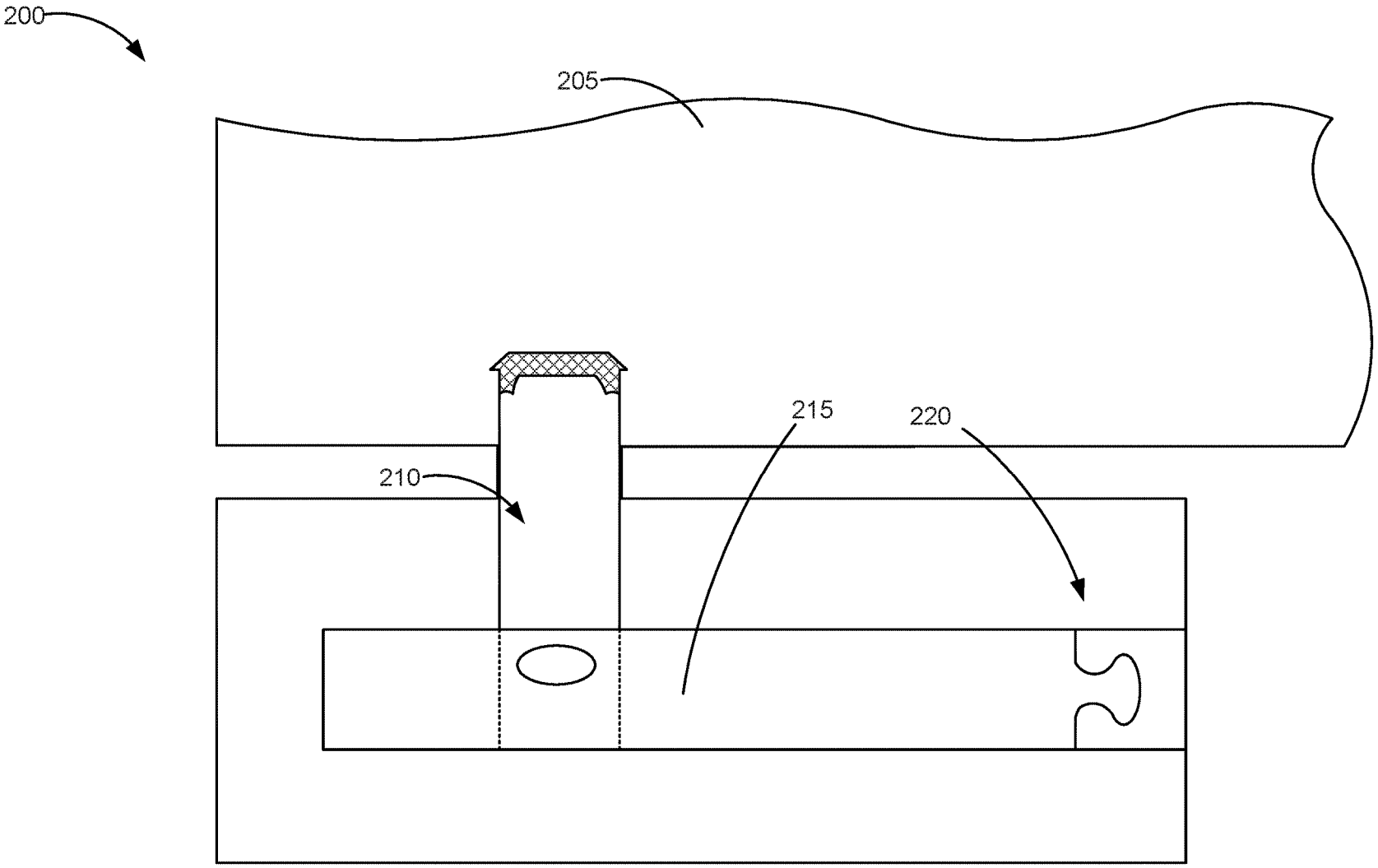
FIG. 2 is a diagrammatic view of a replaceable printing fluid supply according to an example of the principles described herein.

FIG. 2 is a diagrammatic view of a replaceable printing fluid supply (200) according to an example of the principles described herein. The replaceable printing fluid supply (200) may include a container (205) fluidically coupled to a second fluidic channel (210) formed within the replaceable printing fluid supply (200). The replaceable printing fluid supply (200) may further include a first fluidic channel (215) fluidically coupled to the second fluidic channel (210). The first fluidic channel (215) may include a first fluidic valve (220). The first fluidic valve (220) may be any type of fluidic valve and the present specification contemplates the use of any type of valve to prevent printing fluid from passing out of the container (205) downstream of the first fluidic valve (220).

In any of the examples presented herein, the second fluidic channel (210) and first fluidic channel (215) may be offset with respect to each other. The degree to offset of the second fluidic channel (210) to the first fluidic channel (215) will be described in more detail herein. In addition to being offset with respect to each other, the second fluidic channel (210) and first fluidic channel (215) may each be offset from midpoint of the container (205).

Figure 3:
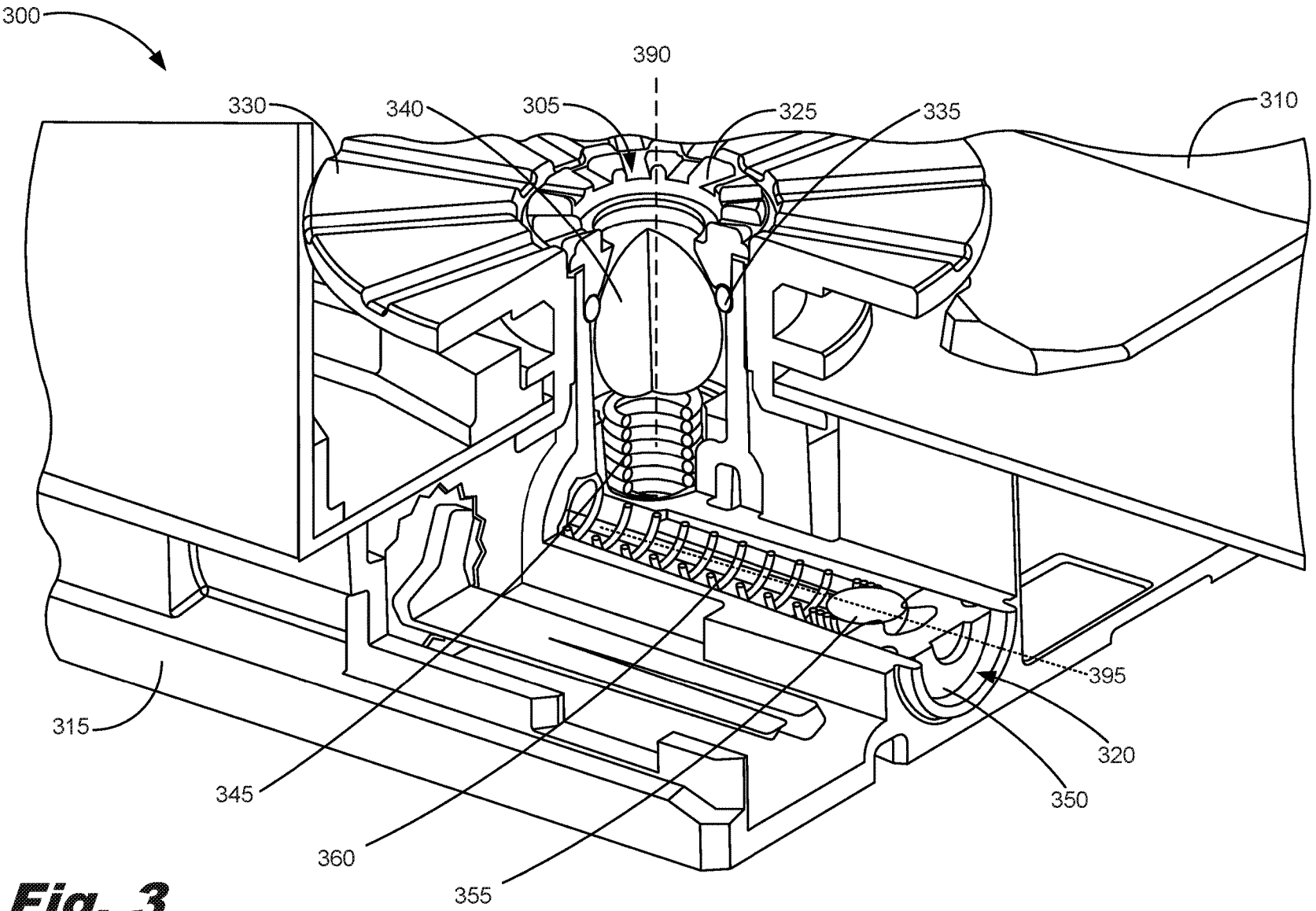
FIG. 3 is a corner cut-out isometric view of a portion of a replaceable printing fluid supply according to an example of the principles described herein.

FIG. 3 is a corner cut-out isometric view of a portion of a replaceable printing fluid supply (300) according to an example of the principles described herein. The replaceable printing fluid supply (300) may include a first fluidic channel (305) leading from an interior of a pliable fluidic bag (310). The first fluidic channel (305) may be formed out of a body of a fluidic interconnect (315) that fluidically couples the pliable fluidic bag (310) to, for example, a printing device.

In the example shown in FIG. 3, the fluidic interconnect (315) includes a second fluidic channel (320). The second fluidic channel (320) may have a longitudinal axis separate from a longitudinal axis of the first fluidic channel (305). In the example shown in FIG. 3, the longitudinal axis (390, 395) of the first fluidic channel (305) and second fluidic channel (320), respectively, are orthogonal to with respect to each other. Additionally, in the example shown in FIG. 3, the first fluidic channel (305) and second fluidic channel (320) are offset with respect to each other. In an example, the offset between the first fluidic channel (305) and second fluidic channel (320) is equal to the diameter of either of the first fluidic channel (305) and second fluidic channels (320). In an example, the offset between the first fluidic channel (305) and second fluidic channel (320) is equal to the sum of the radii of both of the first fluidic channel (305) and second fluidic channels (320).

In the example shown in FIG. 3, the offset of the first fluidic channel (305) with respect to the second fluidic channel (320) creates a fluidic interface between the first fluidic channel (305) and second fluidic channel (320) such that fluid may flow from one to the other. In the example shown in FIG. 3, the first fluidic channel (305) does not bisect the second fluidic channel (320) at the middle of the second fluidic channel (320) but instead the contact point of the first fluidic channel (305) to the second fluidic channel (320) is asymmetrical relative to a longitudinal midpoint of the second fluidic channel (320). This asymmetrical connection point between the first fluidic channel (305) and second fluidic channel (320) may allow for compact placement of the devices formed within the fluidic interconnect (315). Additionally, some fluid flow characteristics may be realized by placing the interface between the first fluidic channel (305) and the second fluidic channel (320) at a location further to a terminal end of the second fluidic channel (320) such as increasing or reducing the flow of fluid.

The first fluidic channel (305) may include a collar (325). The collar (325) may be laser welded to a terminal end of the first fluidic channel (305). Additionally, the collar (325)/first fluidic channel (305) sub-assembly may be press fitted into a spout (330) fused to the pliable fluidic bag (310). Press fitting the collar (325)/first fluidic channel (305) sub-assembly may cause the collar (325)/first fluidic channel (305) sub-assembly to be locked into place. In this example, a lip may be formed between the interface of the collar (325) and first fluidic channel (305) such that the diameter of the collar (325) is larger than the outer diameter of the first fluidic channel (305). The interior diameter of the spout (330) may be equal to the exterior diameter of the first fluidic channel (305). During the press fitting process, the relatively larger diameter of the collar (325) may temporarily expand the interior diameter of the spout (330). When the collar (325) is past a portion of the spout (330), the lip formed may prevent the collar (325)/first fluidic channel (305) sub-assembly from being removed again.

As described herein, the first fluidic channel (305) may include a gasket (335) and a ball (340). The gasket (335) and ball (340) may act as a one-directional valve allowing fluid to flow from the pliable fluidic bag (310) but not into the pliable fluidic bag (310). In an example, back pressure may be created within the first fluidic channel (305) to shove the ball (340) towards the gasket (335). This backpressure may be caused by the elastic nature of the pliable fluidic bag (310). When a negative pressure is no longer realized within the pliable fluidic bag (310) due to fluid being drawn therefrom, the pressure and/or flow of the fluid within the first fluidic channel (305) may cause the ball (340) to rapidly abut the gasket (335) thereby stopping flow of fluid into the pliable fluidic bag (310). In an example, the first fluidic channel (305) may further include a spring (345) that imparts a force against the ball (340) when positive pressure from the draw of fluid from the pliable fluidic bag (310) is present. When no or negative pressure is realized in the first fluidic channel (305), the spring may rapidly press the ball (340) towards the gasket (335) to, again, present backflow of fluid into the pliable fluidic bag (310).

The second fluidic channel (320) may also include a valve to prevent fluid from exiting the fluidic interconnect (315) when the fluidic interconnect (315) is not coupled to, for example, a printing device interface. In the example shown in FIG. 3, the valve includes a septum (350), a ball (355), and a spring (360) as well. Although FIG. 3 shows a specific example of a valve, the present specification contemplates the use of any other type of valve the can be selectively opened during and interfacing process with a printing device.

The septum (350) may include a hole defined along the longitudinal axis (395) of the second fluidic channel (320). The hole may be addressed by a needle from a printing device interface such that insertion of the needle through the hole causes the ball (355) to be moved away from the septum (350) overcoming the force of the spring (360) applied to the ball (355). When the fluidic interconnect (315) is removed from a printing device interface and the needle is removed from the septum (350), the resilient characteristics of the septum (350) may reseal the hole until the fluidic interconnect (315) once again interfaces with a printing device.

During insertion of the needle within the second fluidic channel (320), the needle may push the ball (355) as described herein overcoming the force against the ball (355) applied by the spring (360). Within an interior surface of the second fluidic channel (320), a number of ribs may be formed. The ribs may cause the ball (355) to remain along an axis of the second fluidic channel (320) while allowing a fluid to pass past the ball (355) so as to allow the needle to access the fluid maintained in the replaceable printing fluid supply (300) and specifically within the second fluidic channel (320).

The fluidic interconnect (315) may interface with a number of other devices to form a box-in-bag printing fluid supply and/or a replaceable printing fluid supply. These other devices will be described in more detail with respect to the fluidic interconnect (315).

Figure 4:
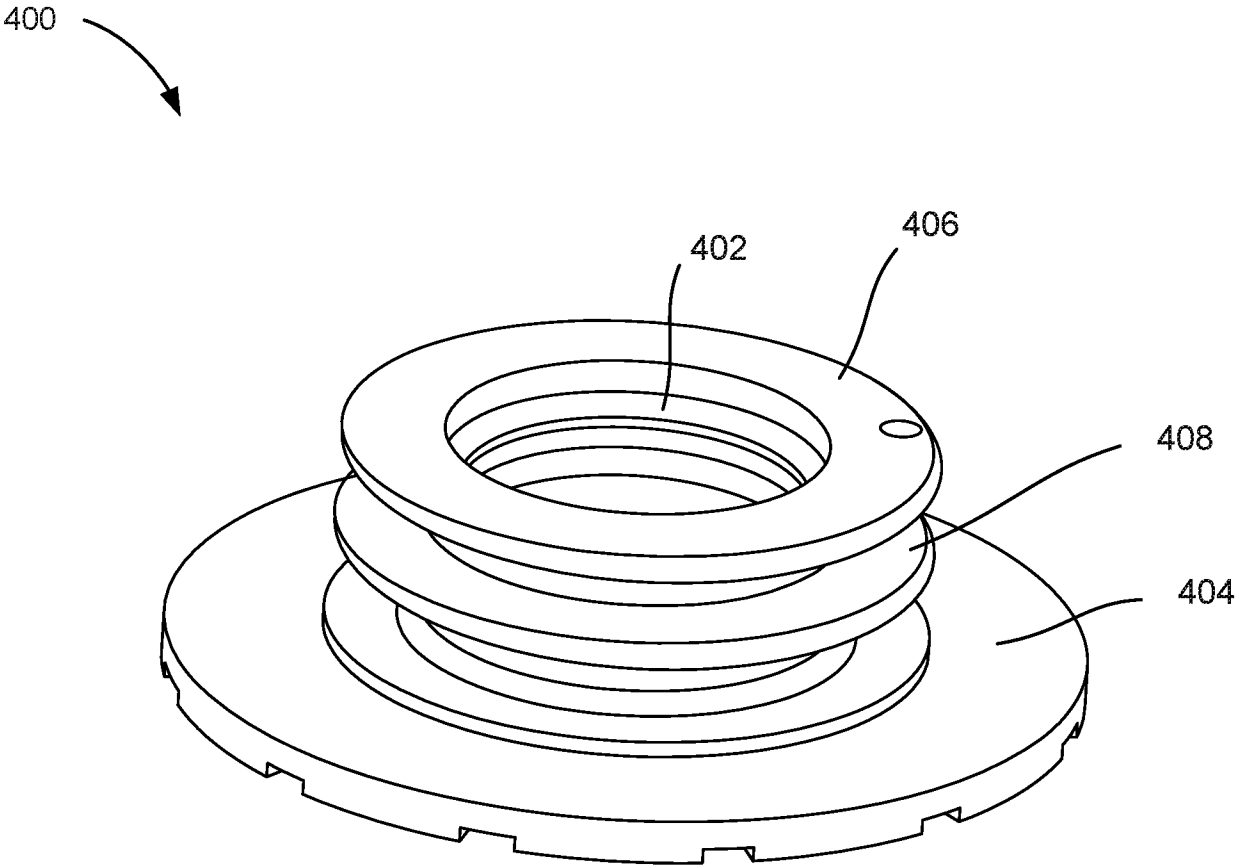
FIG. 4 is an isometric view of a spout with an angled clamp flange for a print liquid supply according to an example of the principles described herein.

FIG. 4 is an isometric view of a spout (400) with an angled clamp flange (408) for a print liquid supply, according to an example of the principles described herein. The spout (400) enables print liquid disposed within a reservoir such as the pliable fluidic container (FIG. 1, 130) to be passed to an ejection device for deposition on a surface. The spout (400) may be formed of any material such as a polymeric material. In a specific example, the spout (400) is formed of polyethylene.

The spout (400) includes various features to ensure accurate and effective liquid transportation. Specifically, the spout (400) includes a sleeve (402) having an opening through which the print liquid passes. The sleeve (402) is sized to couple with a component of a liquid ejection device. For example, the sleeve (102) may be coupled to a receiver port within a printing device. Once coupled, liquid within the reservoir is drawn/passes through the sleeve (102) to the ejection device. That is, during operation forces within the ejection device draw liquid from the reservoir, through the sleeve (102) and into the ejection device. The ejection device then operates to expel the liquid onto a surface in a desired pattern.

The sleeve (402) may be cylindrical and formed of a rigid material, such as a rigid plastic, to facilitate secure coupling to the receiver port. The sleeve (402) may have an inside diameter of between 5 millimeters to 20 millimeters. For example, the sleeve (402) may have an inside diameter of between 10 millimeters and 15 millimeters. As a further example, the sleeve (402) may have an inside diameter of between 11.5 millimeters and 12.5 millimeters.

The spout (400) also includes a first flange (404). The first flange (404) extends outward from the sleeve (402) and affixes the spout (400) to the reservoir. For example, the reservoir may, in an empty state, include a front face and a back face. The front face may have a hole that is sized to allow a second flange (406) and the angled clamp flange (408) to pass through, but not the first flange (404). That is, the first flange (404) may have a diameter that is greater than a diameter of both the angled clamp flange (408) and the second flange (406).

Accordingly, in use, the first flange (404) may be disposed on one side, an interior side, of the front face and the second flange (406) and the angled clamp flange (408) may be disposed on the other side, an exterior side, of the front face. Heat and/or pressure may then be applied to the spout (400) and reservoir such that the first flange (404) material composition and/or the reservoir material composition alters such that the spout (400) and reservoir are permanently affixed to one another. In this fashion, the first flange (402) affixes the spout (400) to the reservoir.

The spout (400) also includes a second flange (406). The second flange (406) similarly extends outward from the sleeve (402). The second flange (406) affixes the spout (400) and corresponding reservoir to the container or box in which they are disposed. That is, during use, it is desirable that the spout (400) remains in one position and not move from that position. Were the spout (400) to move, this might affect the liquid delivery. For example, if the spout (400) were to translate, it may not line up with the interface on an ejection device such that liquid would not be delivered as desired to the ejection device or may not be delivered at all. Moreover, such a misalignment could result in liquid leak and/or damage to components of the ejection device or the liquid supply. Accordingly, the second flange (406), along with the angled clamp flange (408) operate to locate the spout (400) in a predetermined position without movement relative to a container.

More specifically, when installed, the second flange (406) sits on a wall of the container or box in which the reservoir is disposed. A clamp plate and a surface of the print liquid supply container are disposed and squeezed, between the second flange (406) and the angled clamp flange (408). The force between the second flange (406) and the container secures the spout (400) in place relative to the container. As the container is rigid, the spout (400) therefore is rigidly located as well. FIGS. 15A-16E depict the installation and location of the spout (400).

Figure 5:
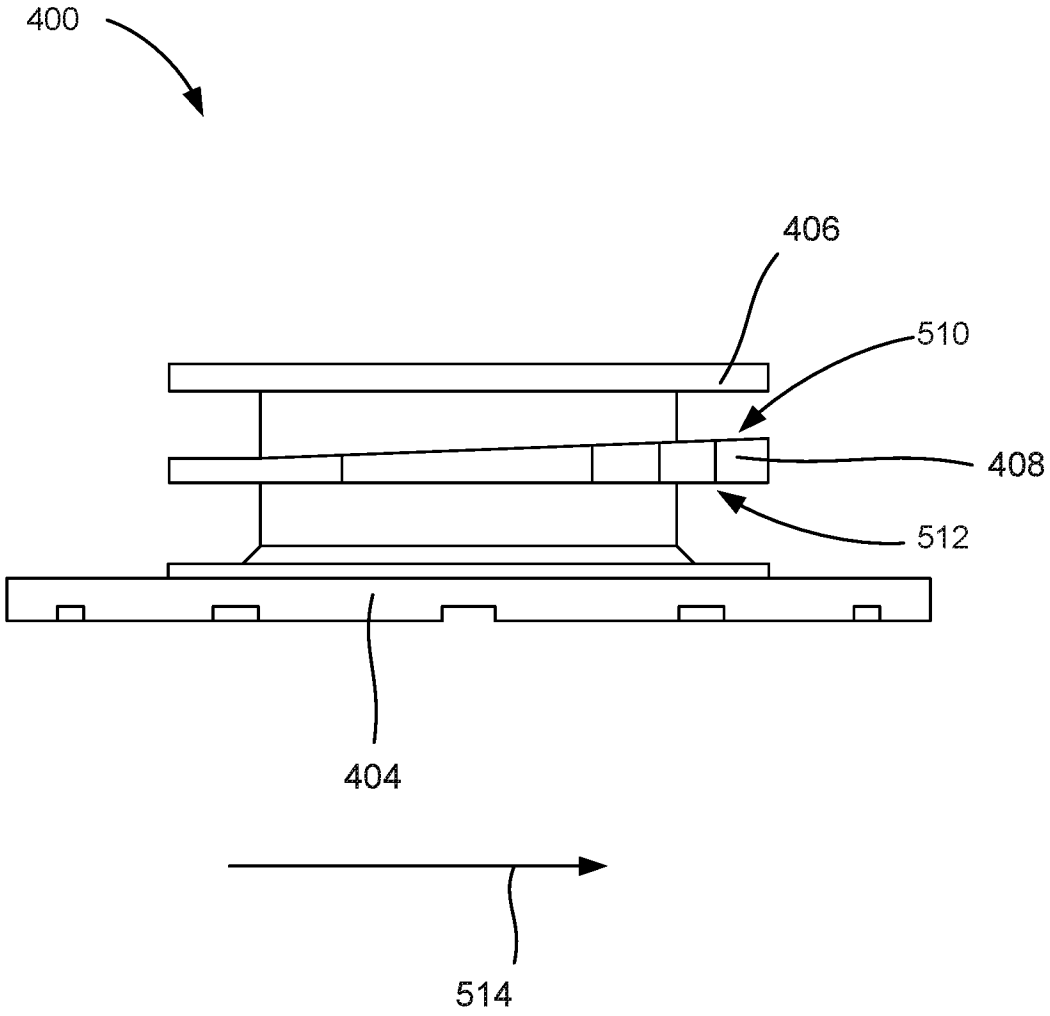
FIG. 5 is a side view of the spout with an angled clamp flange for a print liquid supply according to an example of the principles described herein.

The spout (400) also includes an angled clamp flange (408). As described above, the angled clamp flange (408), along with the second flange (406) securely affix the spout (402), and the reservoir to which it is attached, to the container such that it does not move relative to the container. Any relative movement between the container and the spout (402) may compromise the liquid path between the reservoir and the ejection device thus resulting in ineffective liquid delivery, liquid leaks, and/or component damage. FIG. 5 further depicts the operation of the angled clamp flange (408).

Figure 8:
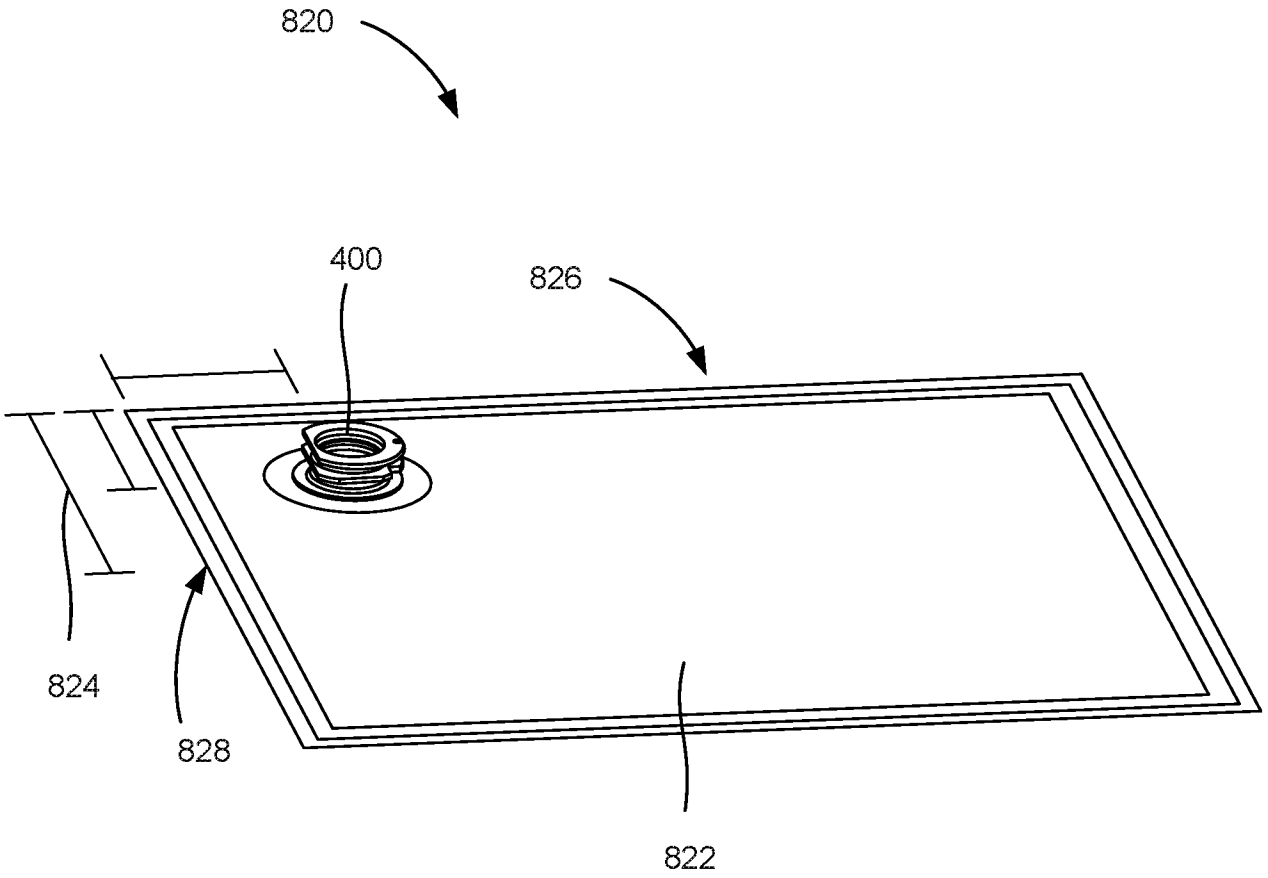
FIG. 8 is an isometric view of a pliable print liquid supply reservoir with an offset spout according to an example of the principles described herein.

Specifically, FIG. 5 is a side view of the spout (400) with the angled clamp flange (408) for a print liquid supply depicted in FIG. 8 herein according to an example of the principles described herein. As depicted in FIG. 5, the angled clamp flange (408) has 1) an angled surface (510) and 2) a straight surface (512) that is opposite the angled surface (510). In some examples, the angled surface (510) has an angle of between 0.5 and 10 degrees relative to the straight surface (512). More specifically, the angled surface (510) has an angle between 0.5 and 8 degrees relative to the straight surface (512). In yet another example, the angled surface (510) has an angle between 0.5 and 3 degrees relative to the straight surface. The angled clamp flange (408) width increases along an insertion direction, which insertion direction is indicated in FIG. 5 by the arrow (514). The angled surface (510) increasing along the insertion direction facilitates the clamping or affixing of the spout to a predetermined location relative to the container. Specifically, as described above, the second flange (406) is to sit on top of a wall of the container. Then a clamp plate is slid along the angled clamp flange (408), and the clamp plate and external surface of the container are compressed between the angled clamp flange (408) and the second flange (406). This compression provides a force that affixes the spout (400) and the associated reservoir to the container.

Accordingly, the spout (400) as described herein is held firmly in place in a position relative to the container, such that the container and the reservoir move as one. Being so disposed, a user can manipulate the container knowing that the spout (400) will remain in that particular position, thus allowing alignment of the spout (400) with a liquid delivery system of the ejection device. Were the spout (400) not held firmly in place, movement of the spout (400) during insertion of the container into the printing device may occur, with such movement affecting the ability to establish a proper fluidic connection between the reservoir and the ejection device. In other words, the spout as described herein allows for the use of a pliable reservoir which can hold large quantities of fluid, is easily manufacturable, and is permeable to liquid and air transfer, all while being simple to insert into an ejection device.

Figure 6:
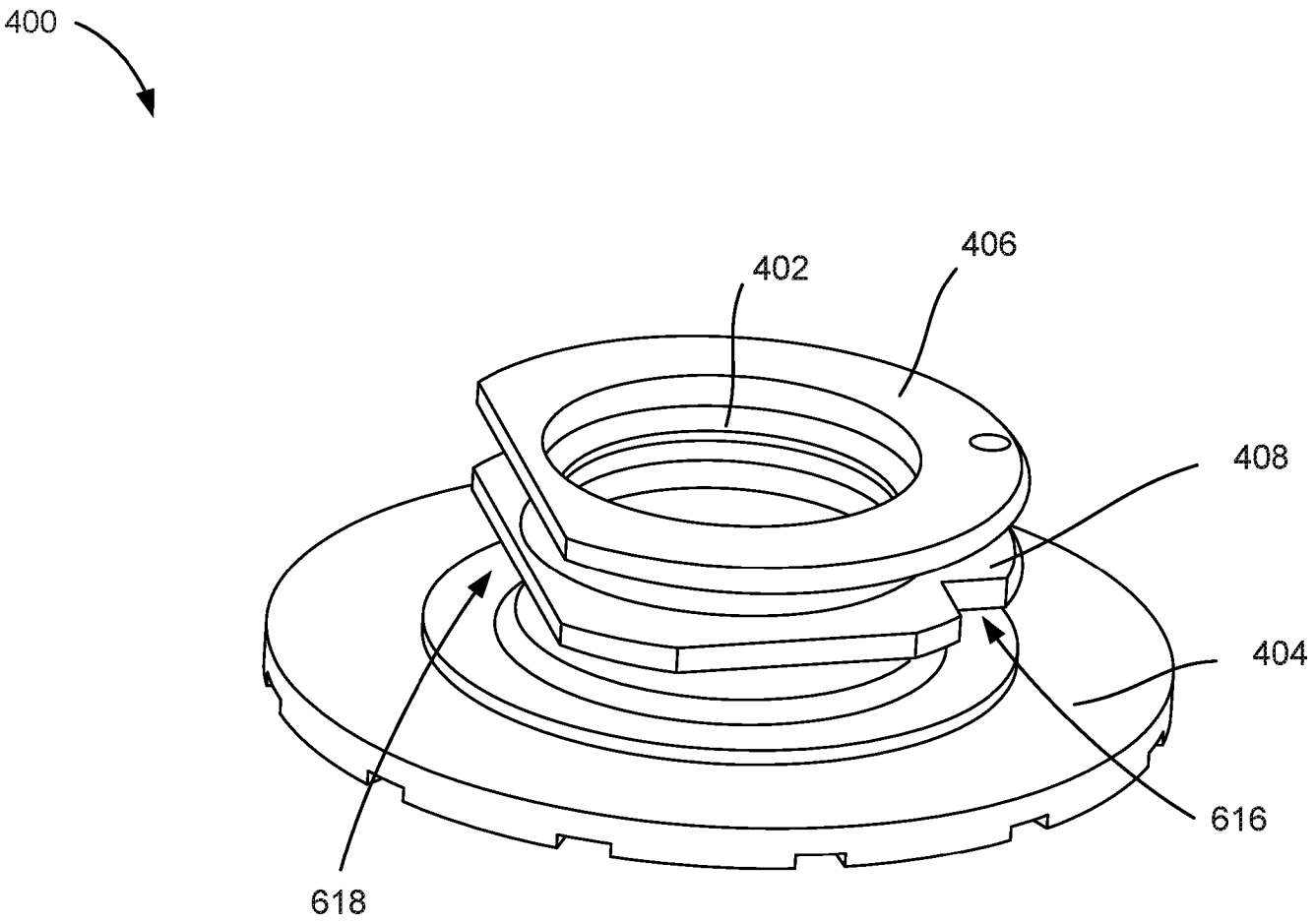
FIG. 6 is an isometric view of a spout with an angled clamp flange for a print liquid supply according to another example of the principles described herein.

In some examples, additional features of the spout (400) may be present. Accordingly, FIG. 6 is an isometric view of a spout (400) with an angled clamp flange (408) for a print liquid supply according to another example of the principles described herein. Specifically, in this example, in addition to the sleeve (402), first flange (404), second flange (406), and angled clamp flange (408), this spout (400) includes at least one notch (616) in the angled clamp flange (408). The at least one notch (616) receives protrusions on the clamp plate and allows the clamp plate to rotate parallel with the second flange (406). That is, the clamp plate may initially be rotated relative to the spout (400) to allow the container to be positioned underneath the second flange (406). Such rotation allows for a large opening for the external surface to be inserted into. That is, if the clamp plate were initially parallel to the second flange (406), there would be little space to insert the container wall, thus impacting the ease of assembly.

Once the sleeve (402) is properly aligned with the wall of the container, protrusions on the clamp plate fit into the notches (616) such that the clamp plate rotates to be parallel to, and adjacent with, the container. Following rotation, the angle of the angled clamp flange (408) forces a sliding clamp plate to compress the container wall against the second flange (406) thus providing the force to retain the spout (400) in place relative to the container. A specific example of the operation of the spout (400) and the clamp plate is provided in connection with FIGS. 15A-16E.

Figure 7:
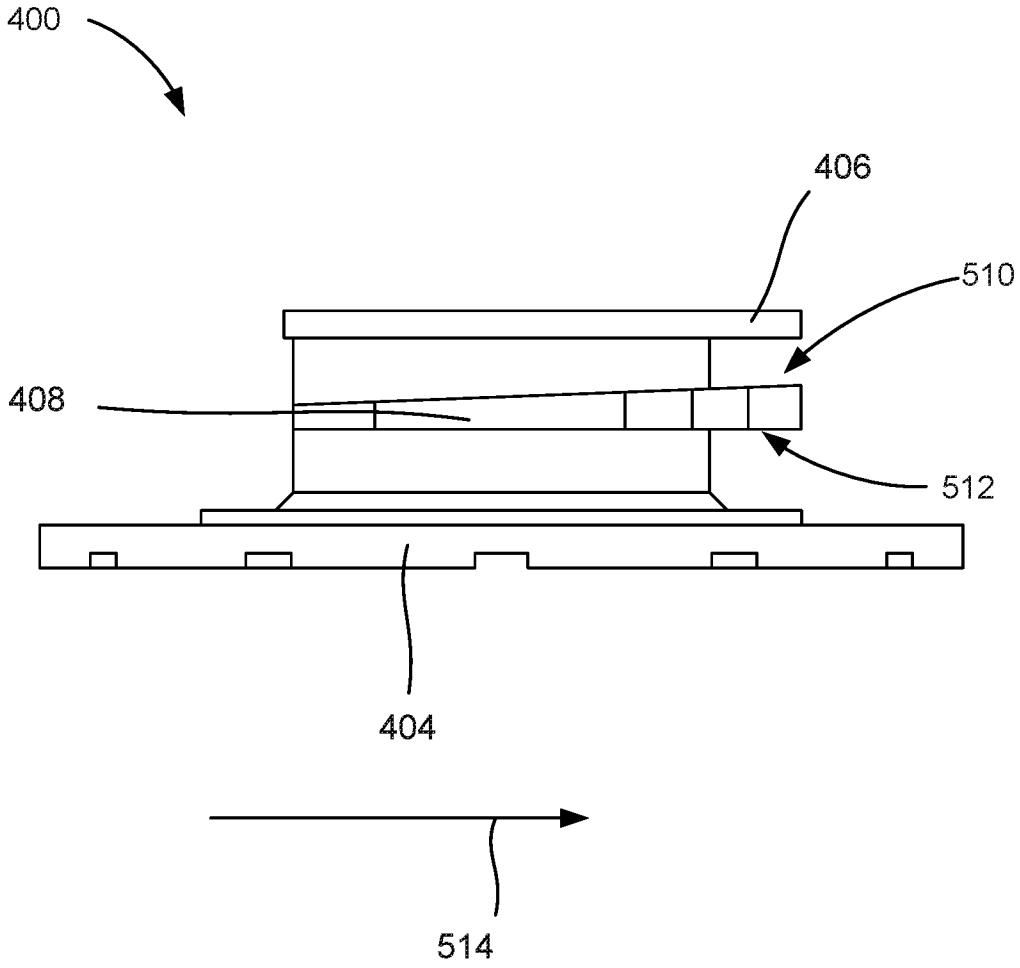
FIG. 7 is a side view of a spout with an angled clamp flange for a print liquid supply depicted in FIG. 4 according to an example of the principles described herein.

FIG. 7 is a side view of a spout (400) with an angled clamp flange (408) for a print liquid supply depicted in FIG. 6 according to an example of the principles described herein. In some examples, the spout (400) also includes an alignment mechanism to align the spout (400) to a predetermined radial position relative to the print liquid supply. That is, as mentioned above, the angled clamp flange (408) may increase in width along an insertion direction (514). Accordingly, the alignment mechanism may ensure that the spout (400) is aligned such that the angled clamp flange (408) increases in width along this insertion direction. That is, the alignment mechanism may ensure that the spout (400) is inserted into the reservoir such that the angled clamp flange (408) is aligned such that a thickest part of the angled clamp flange (408) is further along an insertion direction (514) than a thinner part of the angled clamp flange. Put yet another way, the alignment mechanism ensures that the spout (400) is aligned such that, upon insertion, the clamp plate first interacts with a thin part of the angled clamp flange (408) and later interacts with the thick part of the angled clamp flange (108).

In the specific example depicted in FIGS. 6 and 7, the alignment mechanism is a cutout (618) of at least one of the angled clamp flange (408) and the second flange (406). During insertion of the spout (400) into the reservoir, this cutout (618) may be aligned with a datum surface to ensure a proper alignment.

FIG. 8 is an isometric view of a print liquid supply (820) that includes a spout (400) with an angled clamp flange (408), according to an example of the principles described herein. The print liquid supply (820) includes a pliable reservoir (822). In some examples, the reservoir (822) may be a collapsible reservoir (822). That is, the reservoir (822) may form to the contents disposed therein.

As described above, the reservoir (822) holds any type of liquid such as ink to be deposited on a 2D substrate or an additive manufacturing fabrication agent to be disposed on a 3D build material. For example, in an additive manufacturing process, a layer of build material may be formed in a build area. A fusing agent may be selectively distributed on the layer of build material in a pattern of a layer of a three-dimensional object. An energy source may temporarily apply energy to the layer of build material. The energy can be absorbed selectively into patterned areas formed by the fusing agent and blank areas that have no fusing agent, which leads to the components to selectively fuse together.

Additional layers may be formed and the operations described above may be performed for each layer to thereby generate a three-dimensional object. Sequentially layering and fusing portions of layers of build material on top of previous layers may facilitate generation of the three-dimensional object. The layer-by-layer formation of a three-dimensional object may be referred to as a layer-wise additive manufacturing process.

Figure 9:
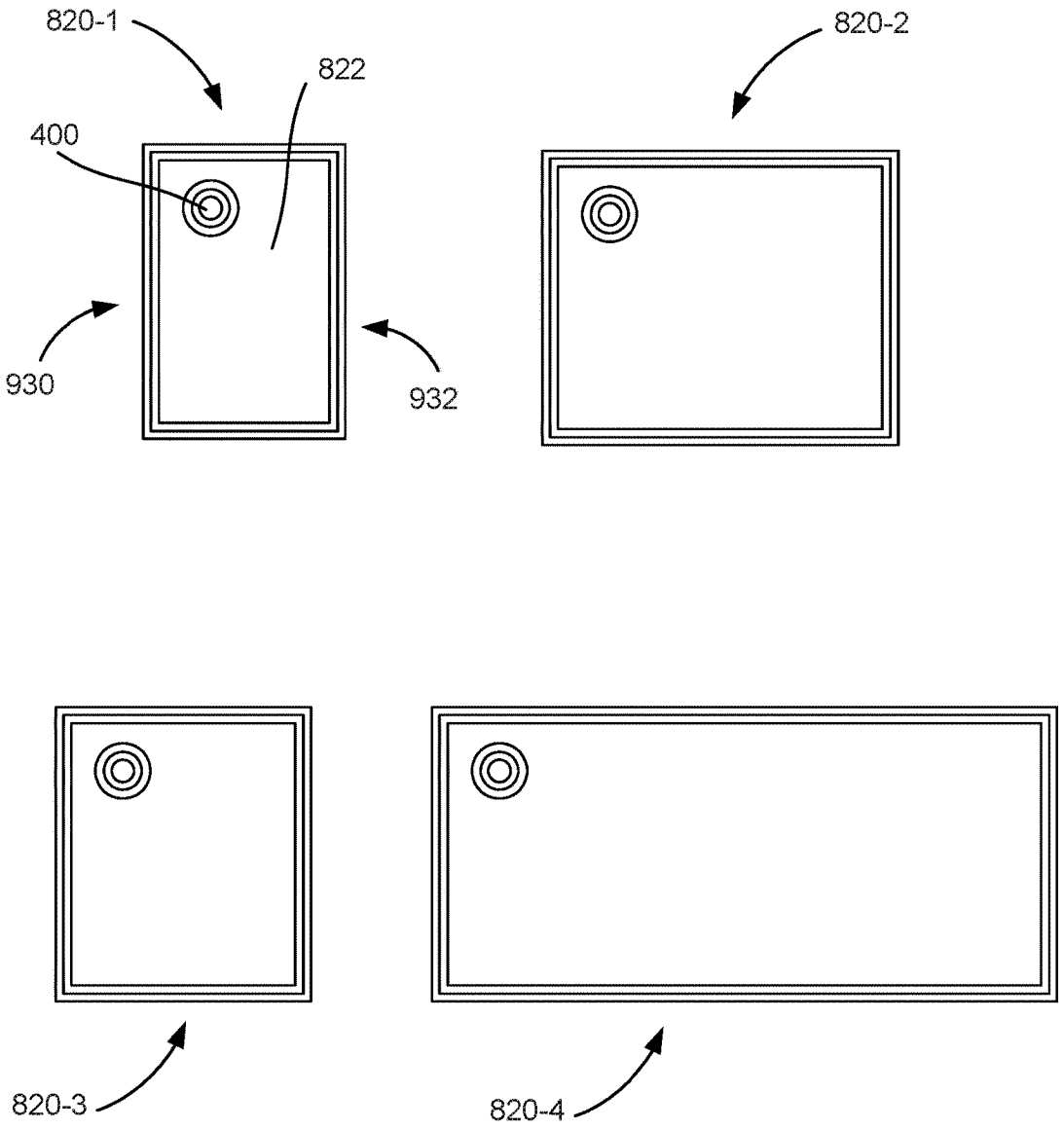
FIG. 9 is a plan view of a plurality of print liquid supply reservoirs with offset spouts according to an example of the principles described herein.

The reservoir (822) may be any size and may be defined by the amount of liquid which it can hold. For example, the reservoir (822) may hold at least 100 millimeters of fluid. While specific reference is made to a reservoir (822) holding a particular amount of fluid, the reservoir (822) may hold any volume of fluid. For example, as depicted in FIG. 9, different reservoirs (522) may hold 100, 250, 500, or 1,000 millimeters of fluid. As depicted in FIG. 8, in a generally empty state the reservoir (822) may have a rectangular shape. While FIG. 8 depicts the corners of the reservoir (822) as being right angles, in some cases the corners may be rounded.

To hold the fluid, the reservoir (822) may have any number of dimensions, for example, the reservoir may be 145 millimeters or more tall and in some particular examples may be between 145 millimeters and 160 millimeters tall when the reservoir (822) is empty. Note that in the figures, references to relative positions such as top, bottom, side and dimensions such as height and width are for reference in the figures and are not meant to be indications of limiting the present description.

The reservoir (822) may be a dual-layer reservoir (822). In any example presented herein, the reservoir (822) may include a pliable front face and a pliable back face (not shown) when empty. The two may be directly joined together using a staking process. The reservoir (822) material is a fluid/air/vapor barrier to inhibit air entry or vapor exit. Specifically, the reservoir (822) may be formed out of a plastic or metallic film to inhibit air/vapor transfer. To have such properties, the front face and/or the back face may be formed of multiple layers, each layer being formed of a different material and having a different property.

FIG. 8 also clearly depicts the spout (400) affixed to the reservoir (822) through which the print liquid passes. Specifically, the spout (400) may be affixed at a corner of the front face at an offset (824) from a centerline of the front face (820). Specifically, the spout (400) may have an offset (824) from the centerline of the reservoir (822). As shown in FIG. 8, the spout (400) may be asymmetrically positioned on the reservoir.

Specifically, the spout (400) may have an offset (824) that is more than 0 mm and 60 mm or less from a centerline of the reservoir (822). For example, the spout (400) may have an offset (824) of between 20-50 millimeters from a centerline of the reservoir (822). As another example, the spout (400) may have an offset (824) at least 48 millimeters from the centerline of the reservoir (822).

In some examples, the spout (400) extends between a center line and an edge of the empty reservoir, for example at a distance from the centerline of at least approximately a sixth, at least approximately a fourth, or at least approximately half of the distance between the center line and the edge.

In addition to having an offset (824) from a centerline of the reservoir (822), the spout (400) may have an offset from a top edge (826) of the reservoir (822) and may have an offset from a side edge (828) of the reservoir (822). Note that the directional indicators top, bottom, and side are used for explanatory purposes in the drawings and may change during operation. For example, the top edge (826) indicated in FIG. 8 may become the bottom edge as the reservoir (822) is inverted during use.

Returning to the offsets, the spout (400) may be offset between 15 and 50 millimeters from the top edge (826) of the reservoir (822) and in some examples may be offset between 25 and 35 millimeters from a top edge (826) of the reservoir (822). Similarly, the spout (400) may be offset between 15 and 50 millimeters from the side edge (828) of the reservoir (822) and in some examples may be offset between 25 and 35 millimeters from the side edge (828) of the reservoir (822).

FIG. 9 is a plan view of print liquid supplies (820-1, 820-2, 820-3, 820-4) having spouts (FIG. 4, 400) with angled flanges (FIG. 4, 408) according to an example of the principles described herein. As described above, each print liquid supply (820) includes a reservoir (822) that has a flat pliable body with a front face and a back face and that is formed of a liquid transfer-inhibiting material. Each liquid supply (820) also includes a spout (400) affixed to the reservoir (822). For simplicity in FIG. 8, the spout (400) and reservoir (822) for just one print liquid supply (820) are indicated with reference numbers.

Each reservoir (822) may include a first wall (930) which may be a wall closest to an insertion point of the reservoir (822) into a container. Each reservoir (822) also includes a second wall (932) which may be opposite the first wall (930) and which in some examples is a wall furthest from the insertion point of the reservoir (822) into the container. That is, when installed, the first wall (930) may be the wall of the reservoir (822) nearest the opening through which the reservoir (822) and its container were installed and the second call (932) may be the wall of the reservoir (822) furthest from the opening through which the reservoir (822) is installed.

Figure 14:
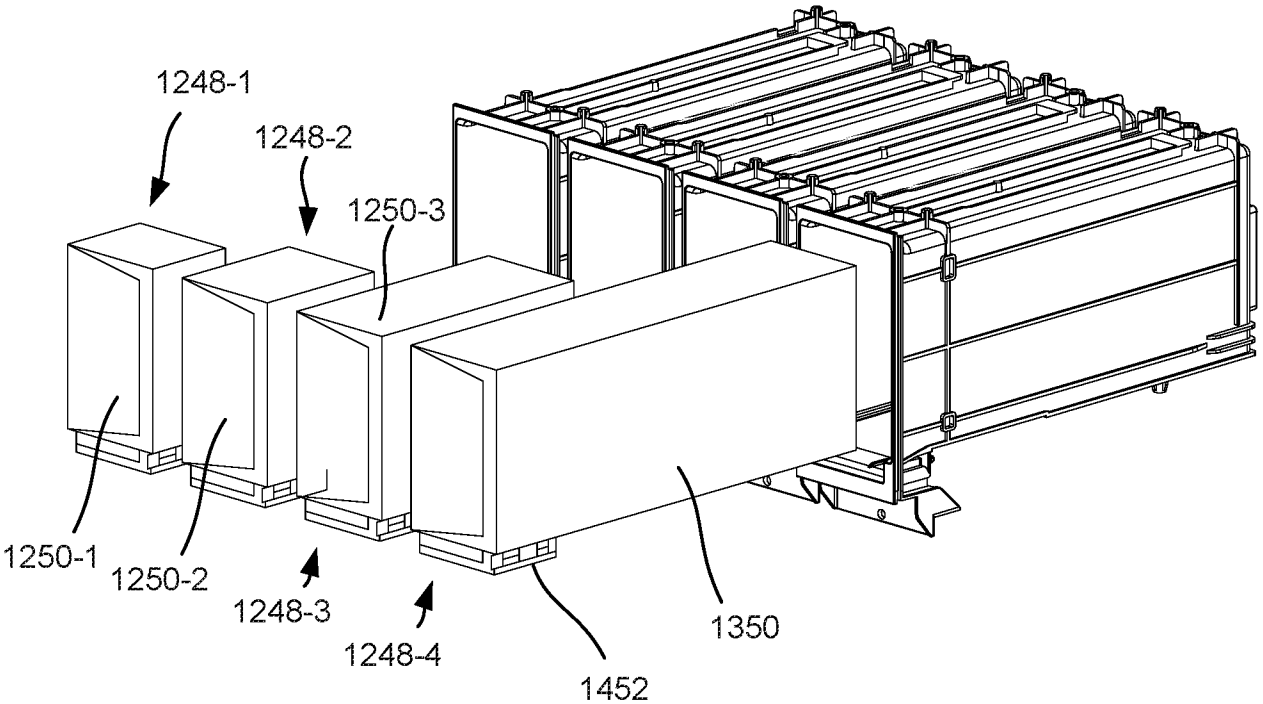
FIG. 14 is an isometric view of different bag-in-box print liquid supplies upon insertion into a printing device according to an example of the principles described herein.

As indicated in FIG. 9, for any size of reservoir (822) the spout (400) is located closer to the first wall (930) than the second wall (932). Moreover, in each case, regardless of the volume, the spout (400) is located the same distance away from the first wall (930). Put another way, each reservoir (822) may hold a different volume of fluid, such as 100 ml, 250, ml, 500, ml and/or 1,000 ml, and may have a different distance between the first wall (930) and the second wall (932). However, spouts (400) of the different reservoirs (822) are located at a same distance, i.e., have a same offset, from the corresponding first wall (930) as compared to other reservoirs (822). Put yet another way, the spouts (400) of the different reservoirs (822) may be the same distance away from the respective corners. Moreover, each reservoir (822) may have the same height. That is, each reservoir (822) may have a different width, i.e., difference between first wall (930) and second wall (932) but may have a height between and including 145 and 160 millimeters tall. As each reservoir (822) has the same height, the corresponding face of a container will similarly be the same. That is, as depicted in FIG. 14, regardless of the size or width of a reservoir (822) and/or container, the front face, or insertion face of the container has the same dimension regardless of the volume of the supply.

Figure 10:
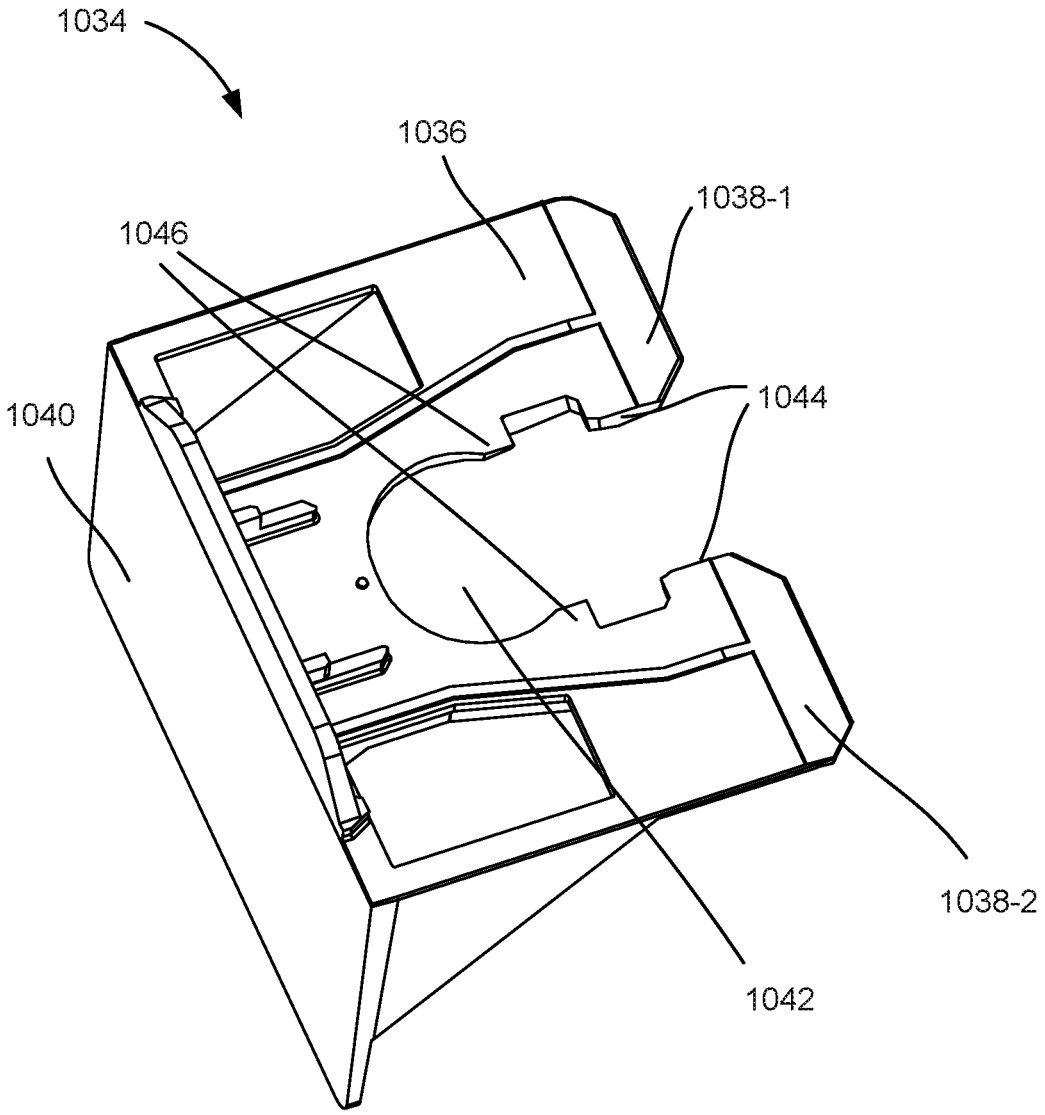
FIG. 10 is an isometric view of a supply container clamp plate with wedge-shaped fork ends according to an example of the principles described herein.
Figure 11:
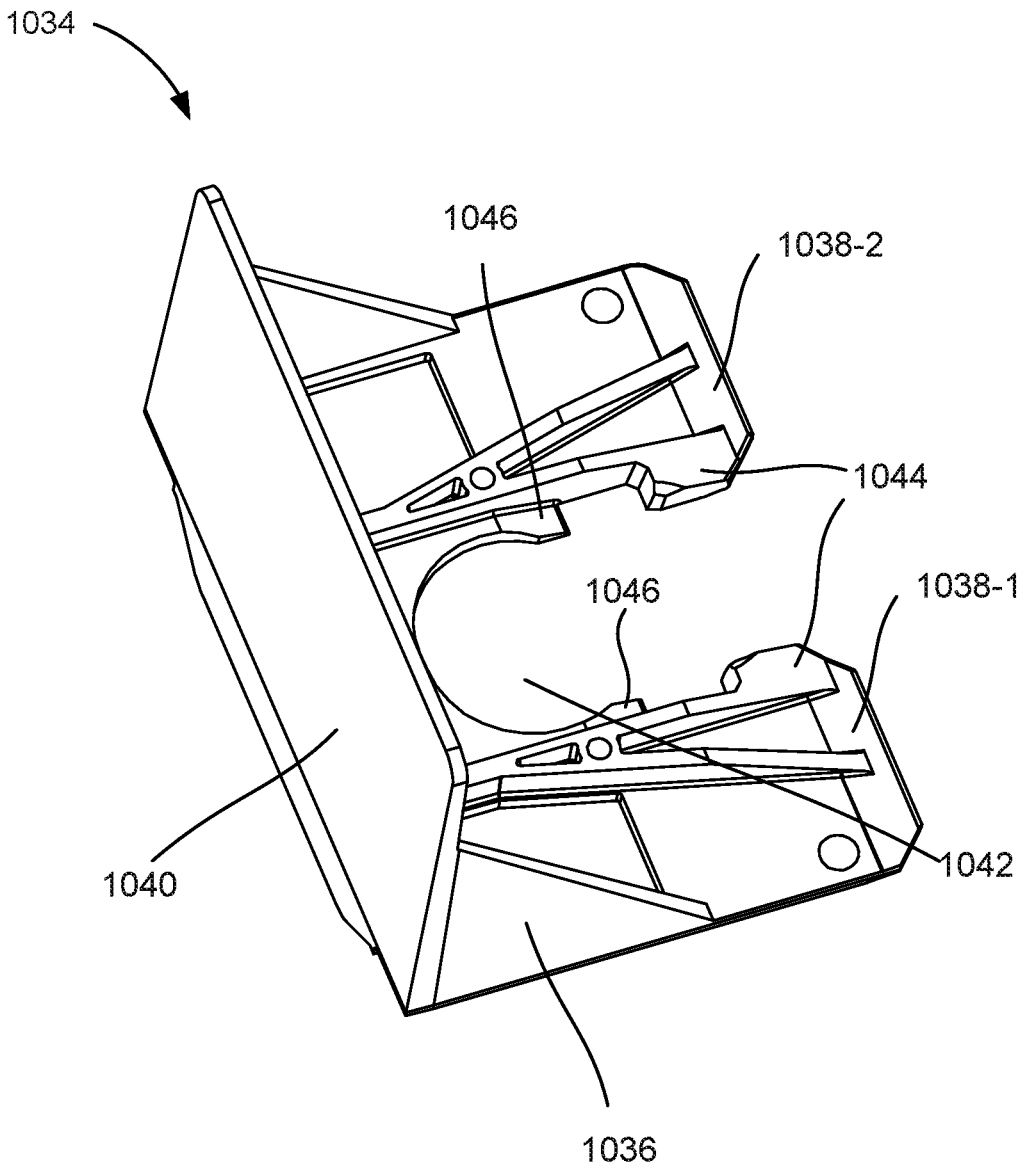
FIG. 11 is an isometric view of a supply container clamp plate with wedge-shaped fork ends according to an example of the principles described herein.

FIGS. 10 and 11 are isometric views of a supply container clamp plate assembly (1034) with wedge-shaped ends (1038-1, 1038-2), according to an example of the principles described herein. The clamp plate assembly (1034) includes a clamp plate (1036) that interfaces with the spout (FIG. 4, 400) as detailed in FIGS. 18A-19E to secure the spout (FIG. 4, 400) and reservoir (FIG. 8, 822) firmly in a predetermined position such that the spout (FIG. 4, 400) can interface with a connection of the ejection device to deliver liquid to the ejection device. The clamp plate assembly (1034) also includes a back plate (1040) that is approximately orthogonal to the clamp plate (1036). Pushing the back plate (1040) engages the wedge-shaped forked ends (1038-1, 1038-2) of the clamp plate (1036) to engage the spout (FIG. 4, 400).

The clamp plate (1036) includes various components to facilitate such an interface with the spout (FIG. 4, 400). Specifically, the clamp plate (1036) includes a slot (1042) defined by two wedge-shaped forked ends (1038-1, 1038-2). The slot (1042) receives and retains the spout (FIG. 4, 100). That is the diameter of the slot (1042) may be the same, or slightly smaller than the outside diameter of the sleeve (FIG. 4, 402) so as to create an interference fit between the clamp plate (1036) and the spout (FIG. 4, 400).

The forked ends (1038-1, 1038-2) may be wedge-shaped. Accordingly, during insertion, the angle of the wedge interfaces with the angle of the angled clamp plate (FIG. 4, 408) to affix the container against the second flange (FIG. 4, 408). The pressure between the container and the second flange (FIG. 4, 408) prevents the relative motion of these components such that a rigid interface is provided. The rigid interface ensures that the spout (FIG. 4, 400) does not move as the container is inserted into a printing device nor during operation. If the spout (FIG. 4, 400) were to move, then there would be difficulty in aligning the spout (FIG. 4, 400) with a corresponding liquid interconnect on the printing device, and uncertainty regarding whether the spout (FIG. 4, 400) is properly aligned with such a liquid interconnect. Such uncertainty is unacceptable as it may lead to less than desired performance, a lack of functionality altogether and/or damage to components.

In some examples, the clamp plate (1036) includes a number of sets of protrusions (1044, 1046) that interface with the spout (FIG. 4, 400) and particularly the angled clamp flange (FIG. 4, 408) during the insertion process. Specifically, during a first stage of insertion, a set of leading protrusions (1044) that protrude in from a leading portion of the slot (1042) align below the angled clamp flange (FIG. 4, 408) and a set of trailing protrusions (1046) that protrude in from a trailing portion of the slot (1042) align above the angled clamp flange (FIG. 4, 408). In other words, the clamp plate assembly (1034) is angled downward respective to the spout (FIG. 4, 400). Doing so provides a large alignment point for the insertion of the container wall. When the container has been positioned between the second flange (FIG. 4, 406) and the angled clamp flange (FIG. 4, 408), the clamp plate assembly (1034) is rotated such that the leading protrusions (1044) pass through the notches (FIG. 5, 516) of the of the angled clamp flange (FIG. 4, 408) such that the leading protrusions (1044) and the trailing protrusions (1046) are above the angled clamp flange (FIG. 4, 408). In this position, the wedge-shaped ends (1038) are prepared to slide along the angled surface (FIG. 5, 510) of the angled clamp flange (FIG. 4, 408) to squish the container and spout (FIG. 4, 400) together. As described above, FIGS. 18A-19E depict this operation.

The clamp plate depicted in FIGS. 10 and 11 may be formed of any material that does not deform in the face of the pressures exerted during insertion. For example, the clamp plate assembly (1034) may be formed out of a thermoplastic polyester material.

Figure 12:
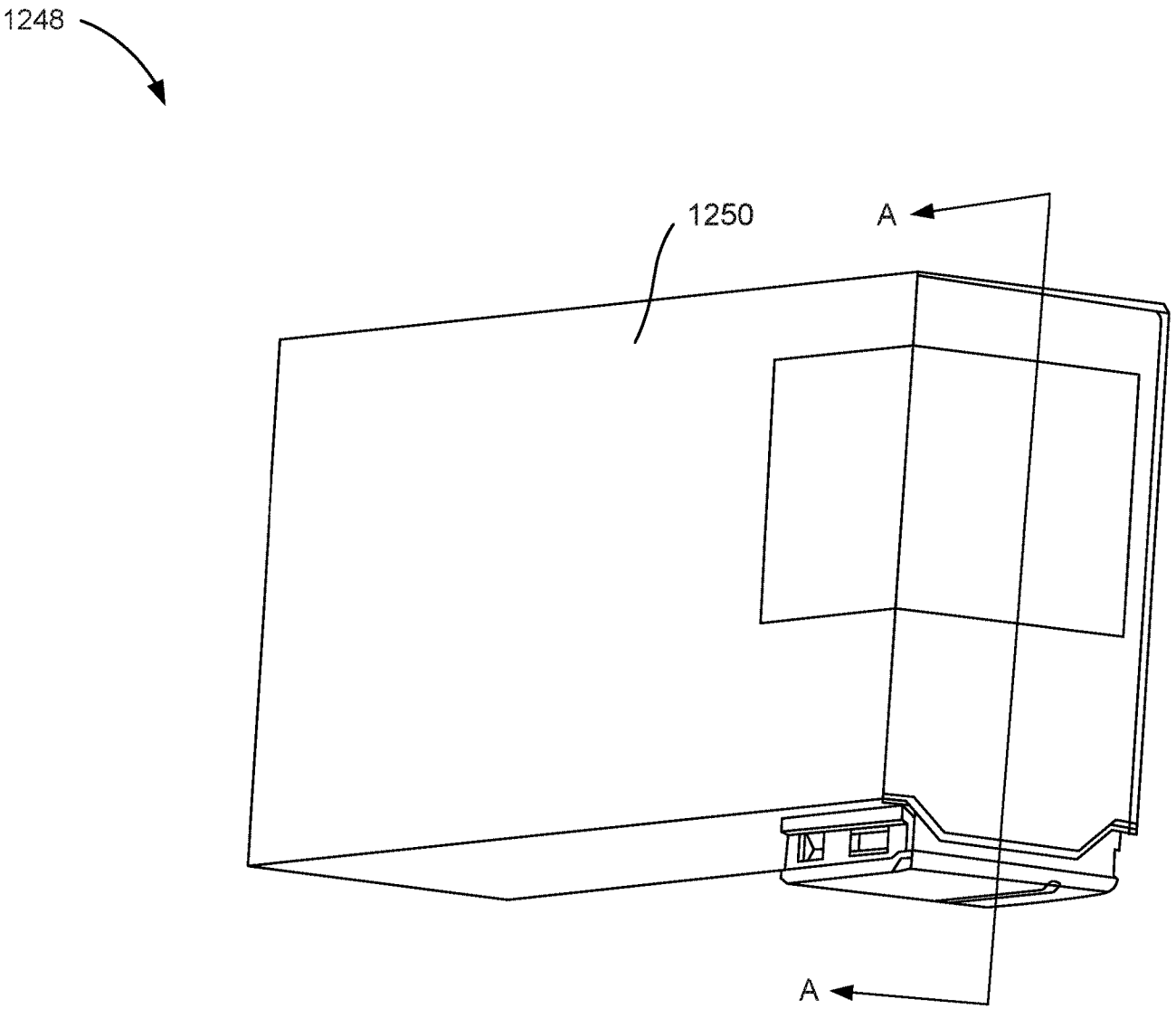
FIG. 12 is an isometric view of a bag-in-box print liquid supply according to an example of the principles described herein.

FIG. 12 is an isometric view of a bag-in-box print liquid supply (1248) according to an example of the principles described herein. As described above, the reservoir (FIG. 8, 822) may be disposed inside a container (1250). The container (1250) provides a rigid structure to be handled by a user during insertion. That is, while the reservoir (FIG. 8, 822) may be easy to manufacture it is difficult to handle and due to its conforming to the shape of the contents therein, may be difficult to insert into, and couple to an ejection device. The container (1250) described herein provides structural strength such that the reservoir (FIG. 8, 822) can be used. The container (1250) may be formed of any material including corrugated fiberboard, which may be referred to as cardboard. The corrugated fiberboard container (1250) may be easy to manufacture and may provide for effective manipulation by a user.

Figure 13:
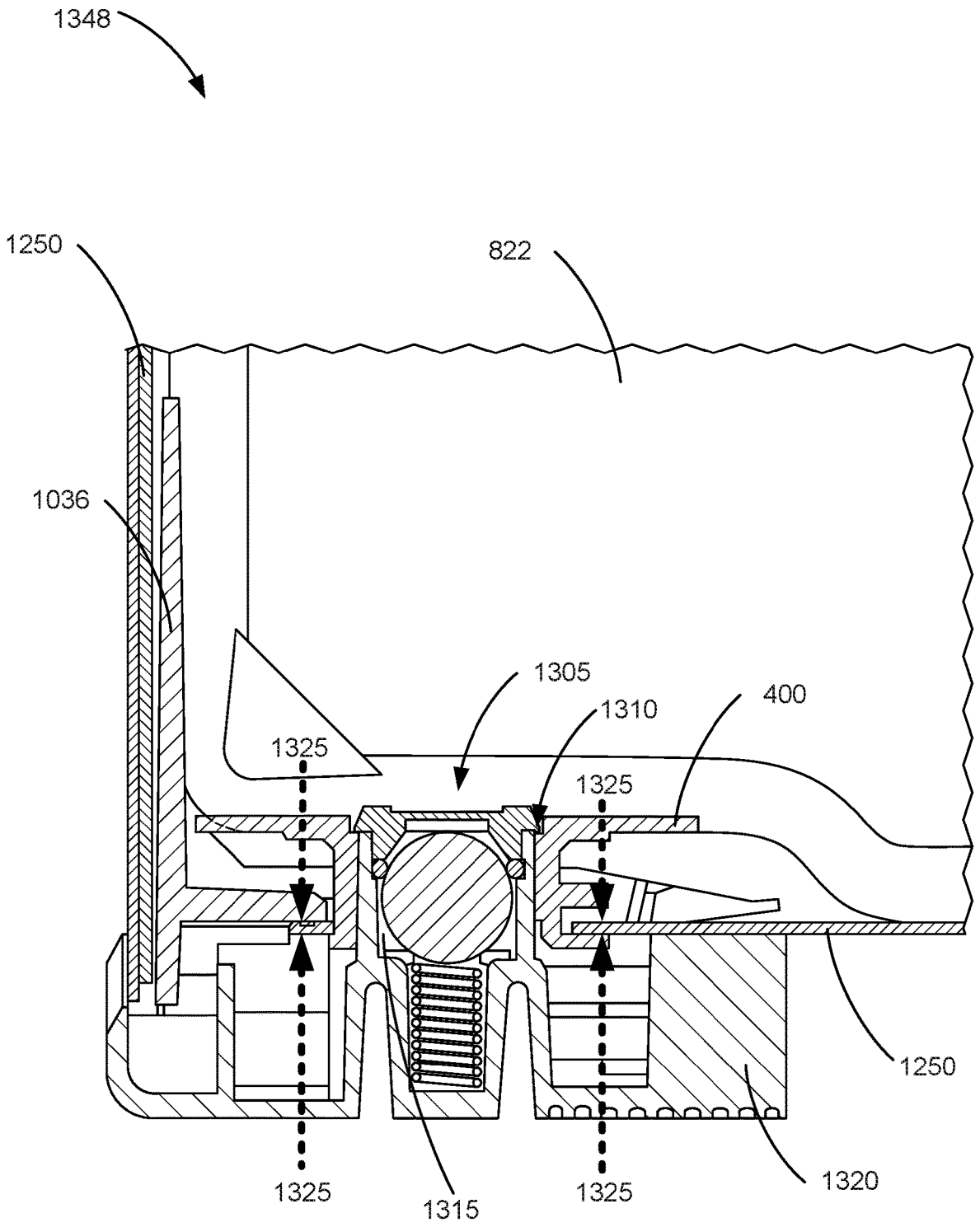
FIG. 13 is a cross-sectional view of a bag-in-box print liquid supply according to an example of the principles described herein.

FIG. 13 is a cross-sectional view of a bag-in-box print liquid supply (1348) according to an example of the principles described herein. Specifically, FIG. 13 is a cross-section taken along the line A-A from FIG. 12. As depicted in FIG. 13, the bag-in-box print liquid supply (1248) includes the pliable reservoir (822), the container (1250) in which the pliable reservoir (822) is disposed, the clamp plate (1036) as described above, and the spout (400) as described above.

The bag-in-box print liquid supply (1248), in any of the examples presented herein, includes a collar (1305). FIG. 13 also shows a lip (1310) formed on the collar (1305). The lip (1310) extends past an exterior circumference of a fluidic channel (1315) formed in a fluidic interface (1320).

FIG. 14 is an isometric view of different bag-in-box print liquid supplies (FIG. 12, 1248-1, 1248-2, 1248-3, 1248-4) upon insertion into a printing device, according to an example of the principles described herein. As described herein, the print liquid supplies (FIG. 12, 1248) provide the print liquid to a printing device or other ejection device. Accordingly, in some examples, a printing device or other ejection device includes ports to receive the print liquid supplies (1248). The slots may have a uniform size opening. Accordingly, the dimension of each print liquid supply container (1250-1, 1250-2, 1250-3, 1250-4), regardless of the volume, may have a size to fit in the opening. That is, each container (1250) depicted in FIG. 14 has a different volume on account of them having different lengths. However, the dimensions of each container (1250) that align with the opening in the port is the same. In some example, the front surface, i.e., the surface exposed to a user, may have an aspect ratio of at least 1.5. As a specific example, each container (1250) face may have an aspect ratio of between 1.5 and 2.0. That is, the height of the container (1250) may be 1.5 to 2 times greater than the width of the container (1250). By having the container (1250) with the same front surface shape and size, regardless of a length, and therefore volume, a variety of volumes of print supplies can be used in a given supply port. That is, rather than being limited to a size of a print supply, a port can accept a variety of containers (1250) having different volumes, each with the same front surface size and shape.

FIG. 14 also depicts the location of the spouts (FIG. 4, 400). That is, the spouts (FIG. 4, 400) may be disposed under the fluidic interface (1452) depicted in FIG. 14. In some examples described herein, the fluidic interfaces (1452) may also be referred to as a liquid bag interface. Accordingly, as depicted in FIG. 14, the spouts (FIG. 4, 400) may be disposed at a corner of the reservoir (FIG. 8, 822), such that upon insertion of reservoir (FIG. 8, 822) into the container (1250), the spout (FIG. 4, 400) is at a corner of the container (1250) that is to be adjacent an opening of the port. Still further, the spout (FIG. 4, 400) may be disposed at a corner of the reservoir (FIG. 8, 822) such that upon insertion of the reservoir (FIG. 8, 822) into the container (1250), the spout is at a corner of the container (1250) that is to be adjacent to a bottom of the port. Doing so facilitates liquid flow out of the reservoir (FIG. 8, 822) as gravity will naturally draw the liquid down and out.

Figure 15:
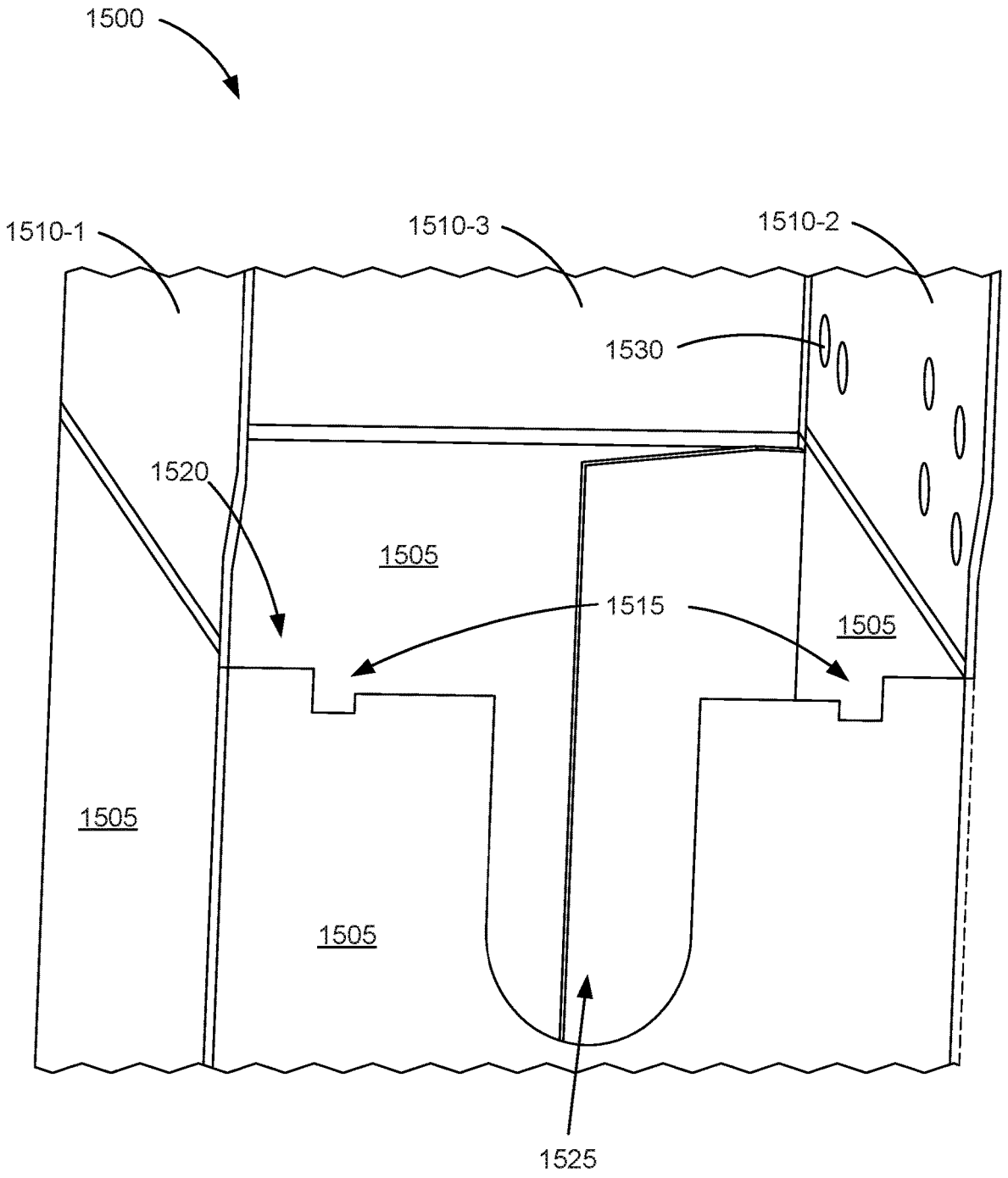
FIG. 15 is an isometric view of an opening of a bag-in-box print liquid supply according to an example of the principles described herein.

FIG. 15 is an isometric view of an opening of a bag-in-box print liquid supply (1500), according to an example of the principles described herein. As described herein, the bag-in-box print liquid supply (1500) may include a number of walls (1505) formed into a cuboid shape. In any example described herein, one of the walls (1505) of the cuboid shape may be formed by a number of flaps (1510-1, 1510-2, 1510-3), each of which when folded against each other form a wall (1505). In this example, the flaps (1510-1, 1510-2, 1510-3) may serve as an entry location for a pliable bag to be inserted into the bag-in-box print liquid supply (1500) during assembly of the bag-in-box print liquid supply (1500).

The bag-in-box print liquid supply (1500) may further include a number of alignment structures (1515) used to align a support element with the walls (1505) of the bag-in-box print liquid supply (1500). In an example, the support element includes the clamp plate (FIG. 10, 1036) described herein. In these examples, features formed on the clamp plate (FIG. 10, 1036) may fit within the alignment structures (1515) such that the clamp plate (FIG. 10, 1036) may fit therein and lie flush against the edge (1520) of the wall at which the alignment structures (1515) are cut into.

The bag-in-box print liquid supply (1500), in an example, includes a channel (1525) through which the spout (FIG. 4, 400) of the reservoir (FIG. 8, 822) may be placed along with the clamp plate (FIG. 10, 1036). In an example, the clamp plate (FIG. 10, 1036) may include a number of elongated alignment fingers formed thereon to interface with edges of the channel (1525) creating a fit between the clamp plate (FIG. 10, 1036) and a wall (1505) of the bag-in-box print liquid supply (1500).

In any example described herein, any number of flaps (1510-1, 1510-2, 1510-3) may include a number of holes (1530) or voids formed therein. The holes (1530) may be used to maintain an amount of adhesive material therein as the liquid impermeable liquid bag (310) is being closed. In an example, the adhesive material may be used to adhere one of the flaps (1510-1, 1510-2, 1510-3) to another as well as adhere a number of the flaps (1510-1, 1510-2, 1510-3) to the back plate (FIG. 10, 1040) of the clamp plate (FIG. 10, 1036). Once the adhesive material has cured, the bag-in-box print liquid supply (1500) may remain closed housing the pliable bag inside full of fluid.

Figure 16A:
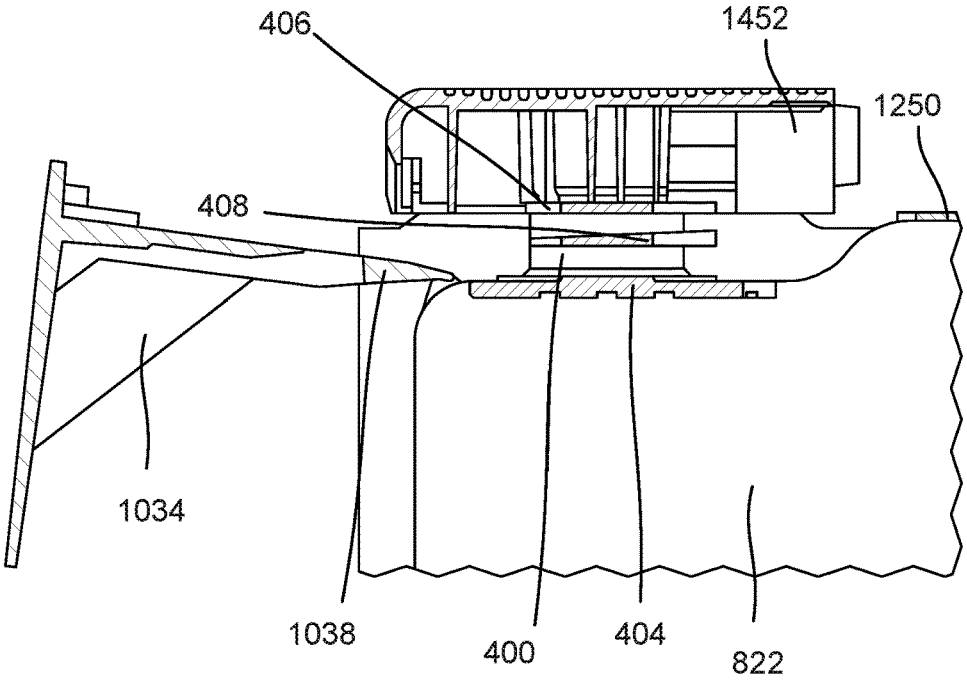
FIGS. 16A-16F and 17A-17E illustrate a cross-sectional views and isometric views, respectively of the assembly of a print liquid supply according to an example of the principles described herein.
Figure 16B:
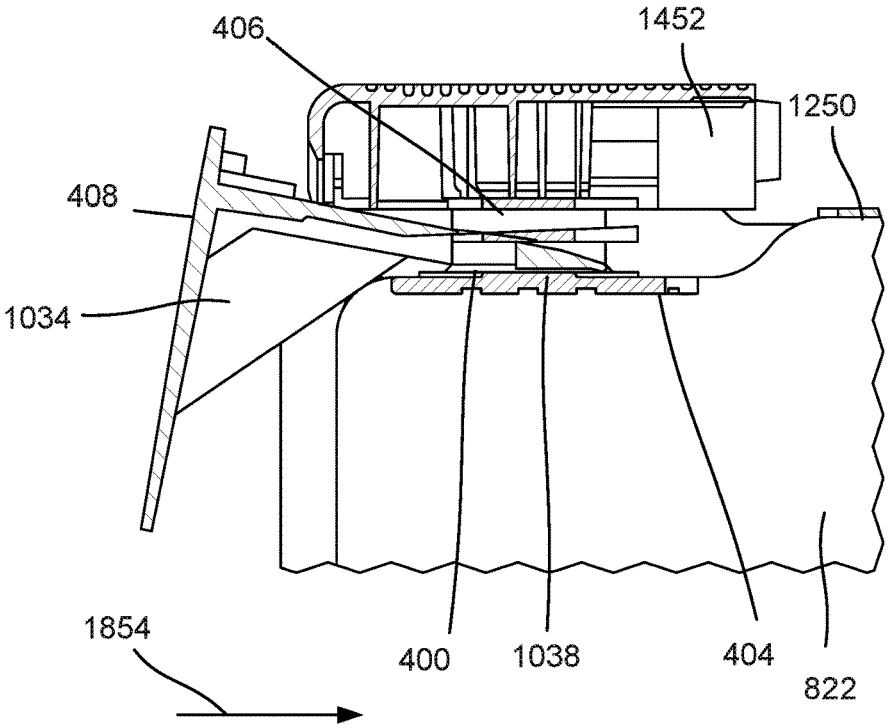
Figure 16C:
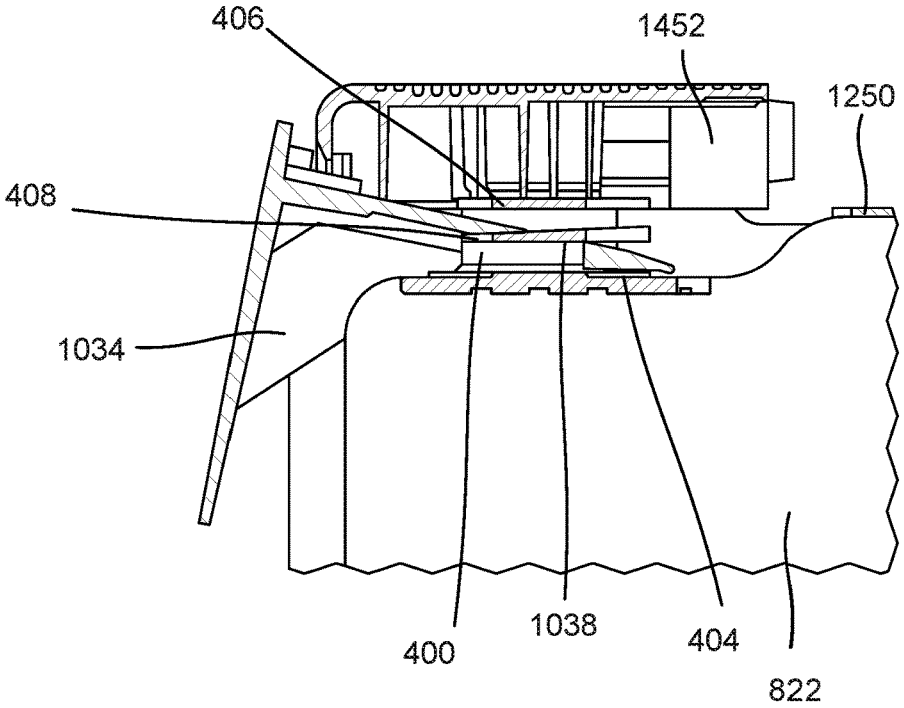
Figure 16D:
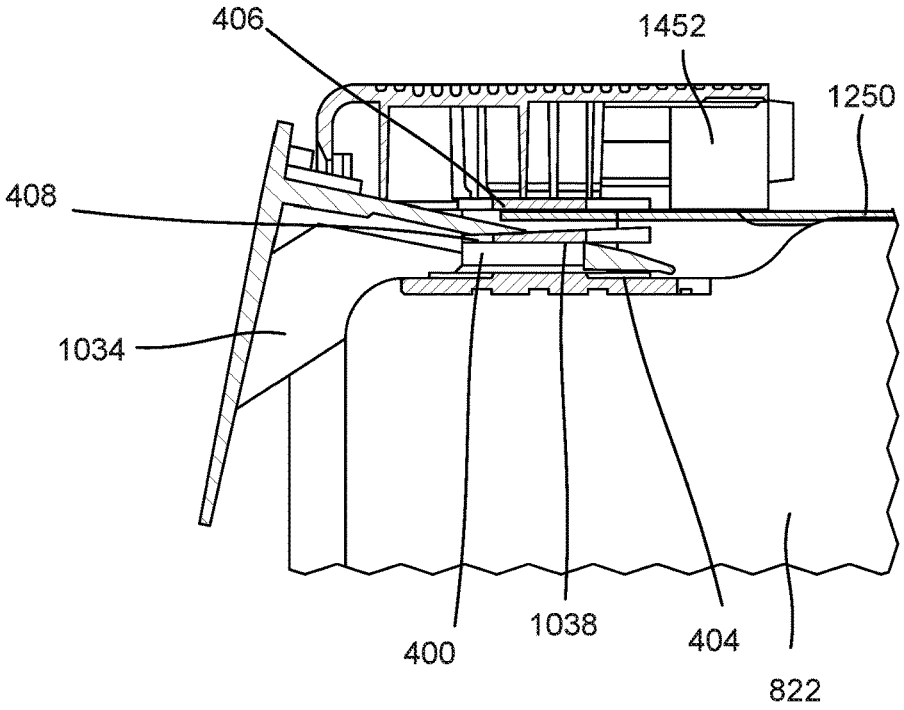
Figure 16E:
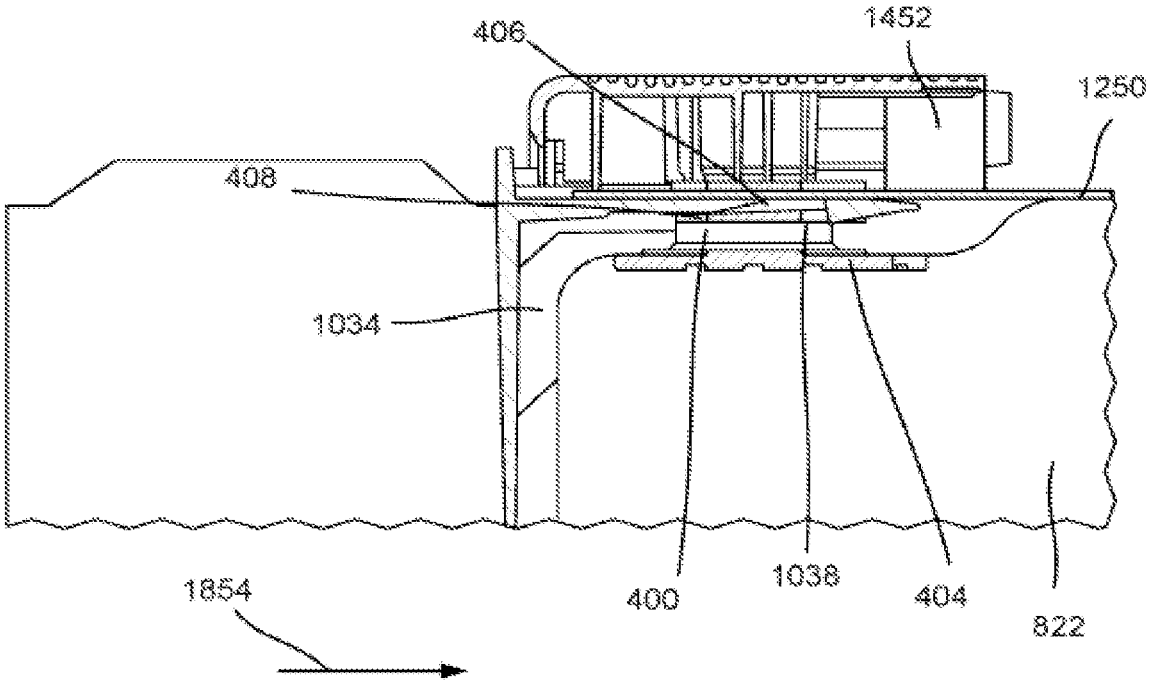
Figure 16F:
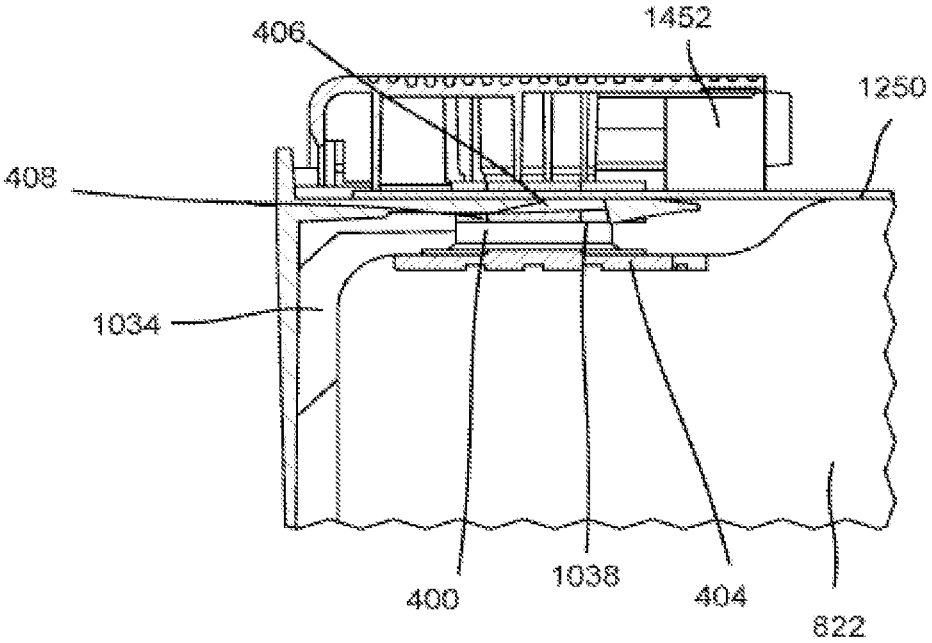
Figure 17A:
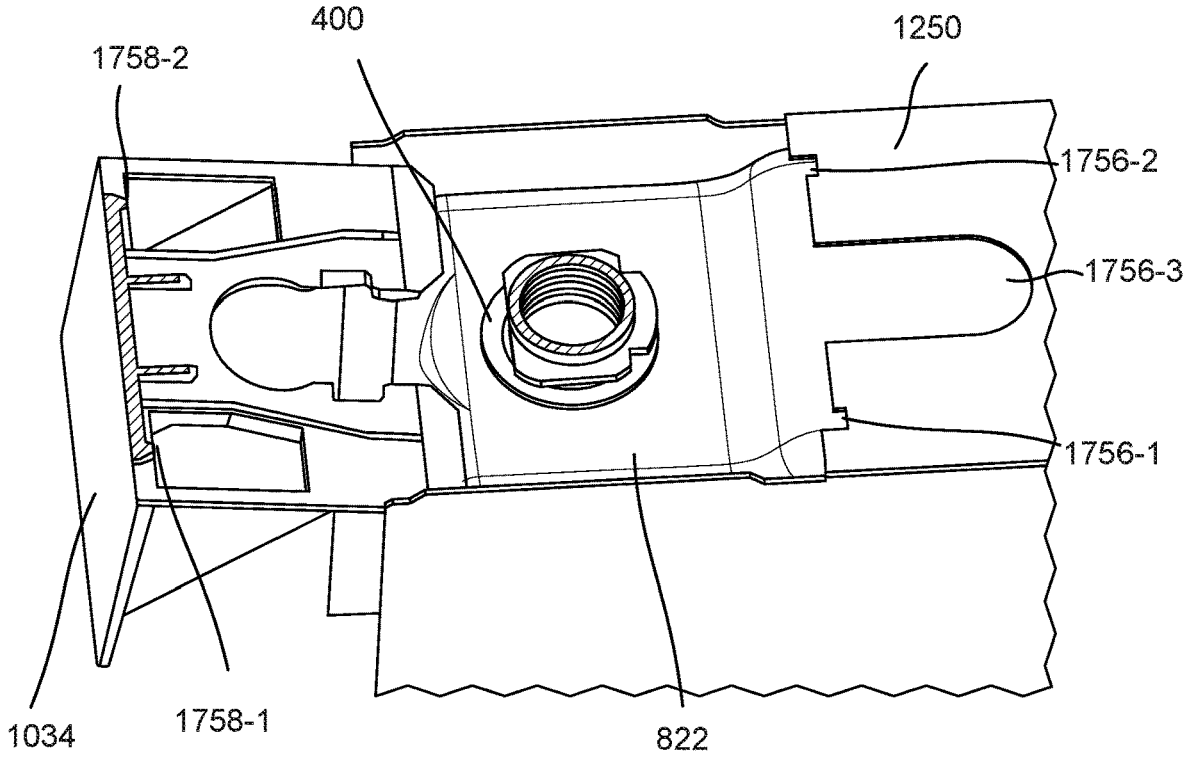
Figure 17B:
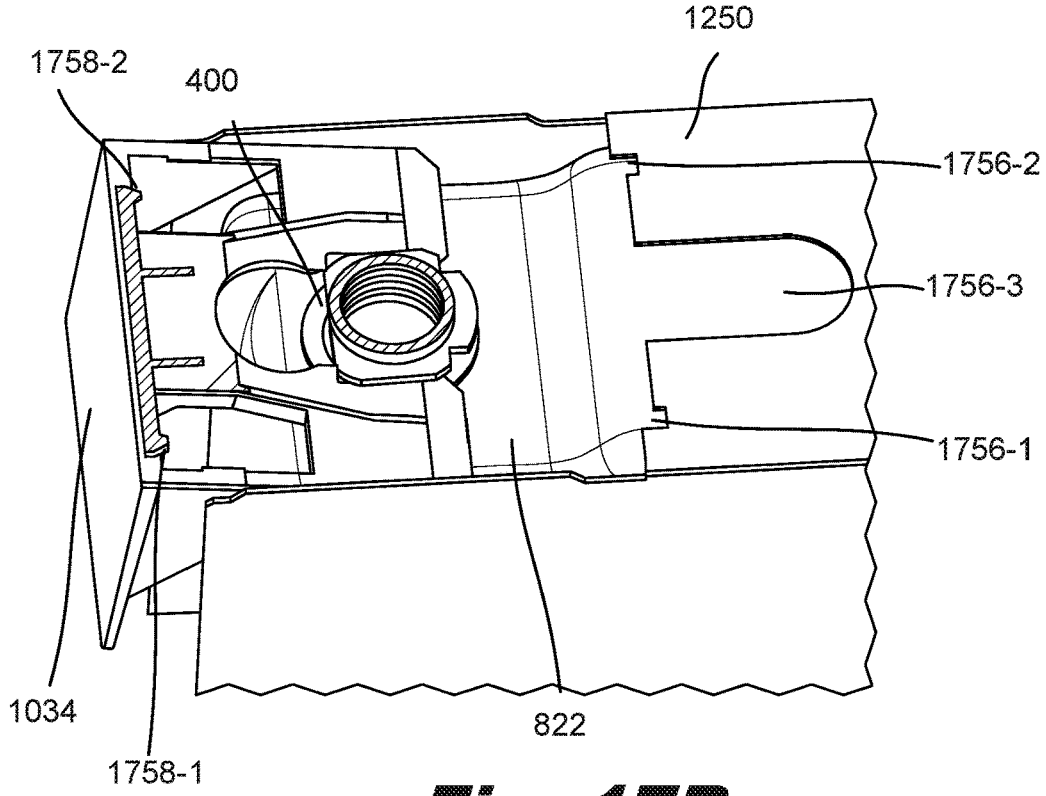
Figure 17C:
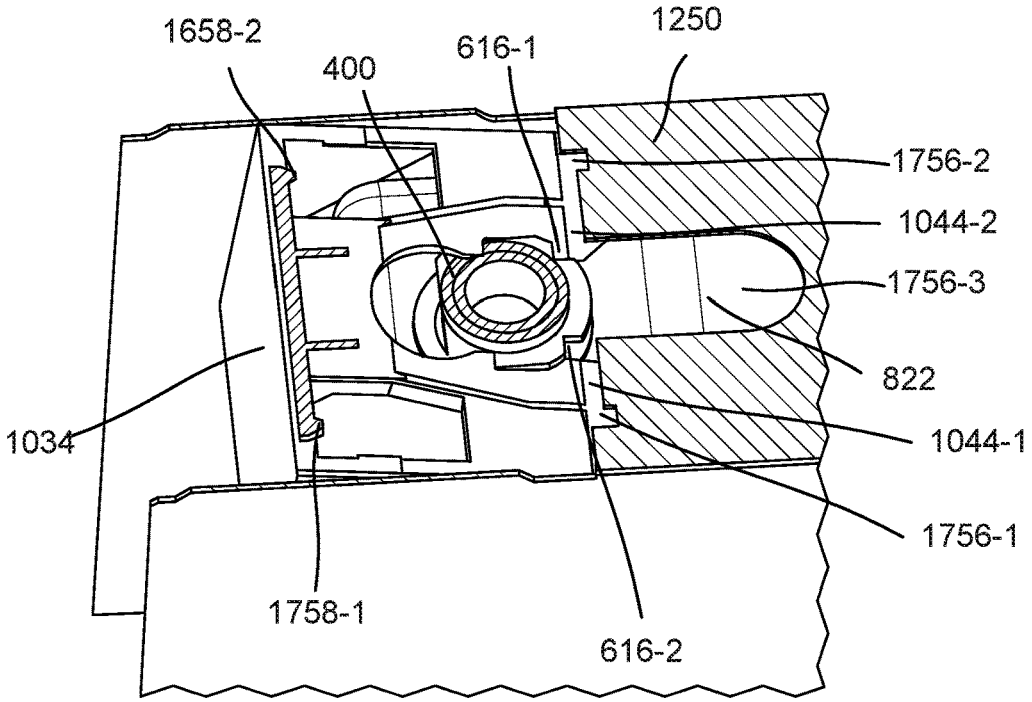
Figure 17D:
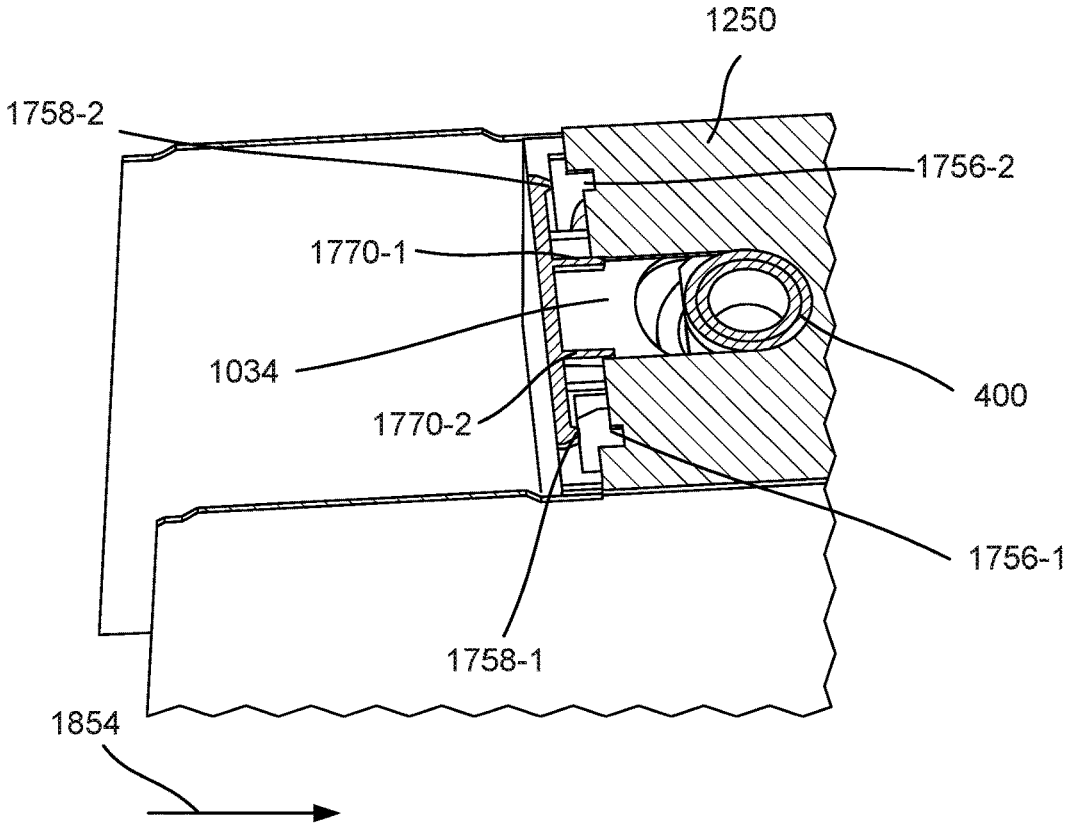
Figure 17E:
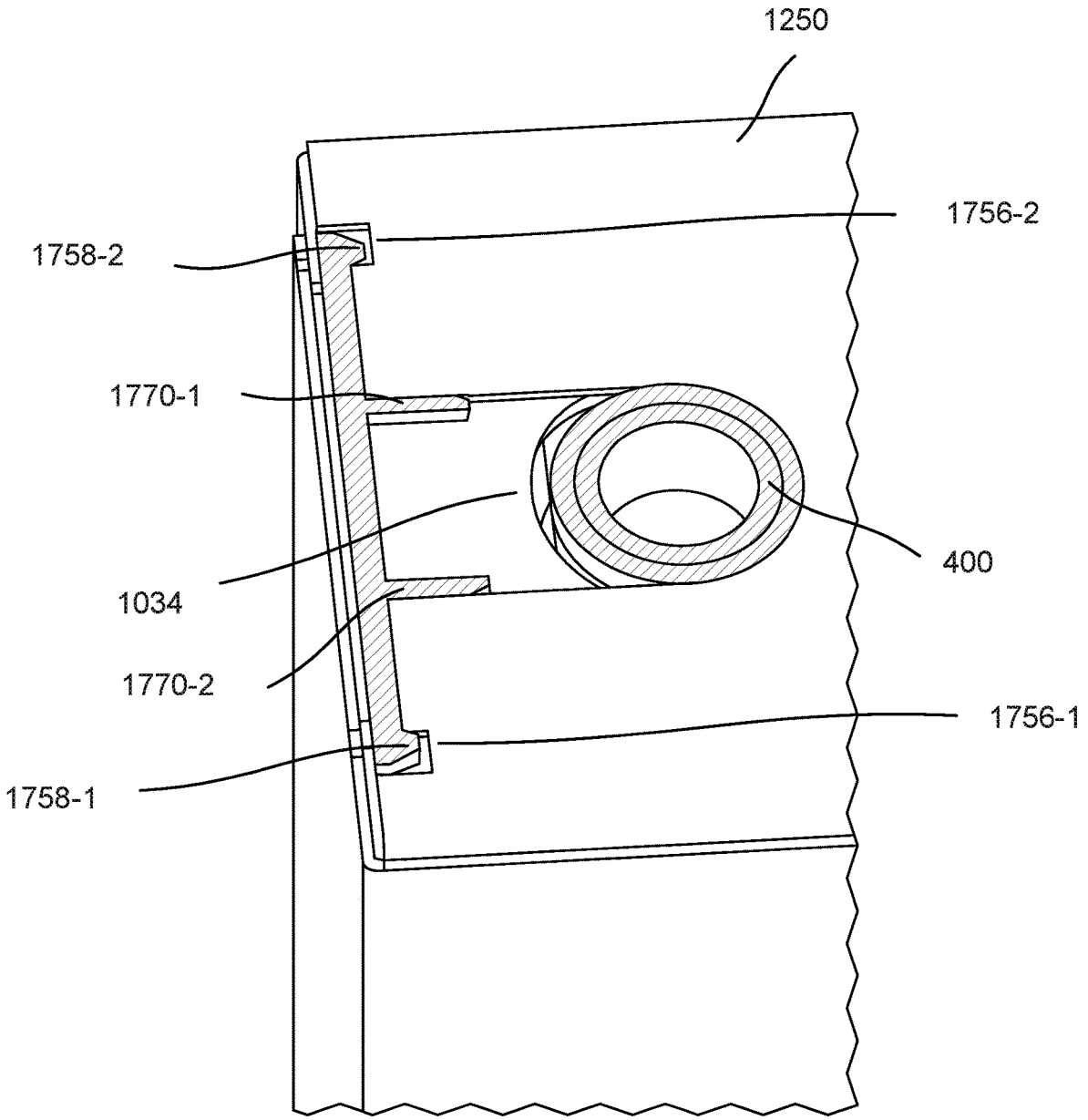

FIGS. 16A and 16B illustrate a cross-sectional view and isometric view, respectively of the assembly of a print liquid supply according to an example of the principles described herein. As described herein, the print liquid supply includes many components such as a reservoir (822), a spout (400), and a clamp plate assembly (1034) that are all, at least partially disposed within a container (1250). The system also includes a fluidic interface (1452) that provides an interface between the printing device in which the supply is inserted. As depicted in FIGS. 16A and 16B, the spout (400) has been attached to the reservoir (822) via a staking or other operation such that the first flange (404) is disposed on an inside of the reservoir (822). FIG. 16A also clearly depicts the angle of the wedge-shaped forked ends (1038). In some examples, the angle of these wedge-shaped ends (1038) matches an angle of the angled surface (FIG. 5, 510) of the angled clamp flange (408).

As depicted in FIG. 16A, the clamp plate assembly (1034) is aligned at an angle relative to the spout (400). Specifically, they are aligned such that as the clamp plate assembly (1034) is slid forward in a direction indicated by the arrow (1654) leading protrusions (FIG. 10, 1044) on the clamp plate assembly (1034) are aligned below the angled clamp flange (408) and the trailing protrusions (FIG. 10, 1046) on the clamp plate assembly (1034) are aligned above the angled clamp flange (408). Doing so creates a large window in which the container (1250) can be inserted. Put another way, during a first stage of insertion of the clamp plate assembly (1034), the straight surface (FIG. 5, 512) of the angled clamp flange (408) interfaces with the leading protrusions (FIG. 10, 1044) on the clamp plate (1036) to maintain the clamp plate assembly (1034) at a non-parallel angle relative to the angled clamp flange (408). The clamp plate assembly (1034) will remain in this angled orientation until the leading protrusions (FIG. 10, 1044) align with the notches (FIG. 6, 616) in the angled clamp flange (408).

FIG. 16B also depicts the alignment mechanism on the container (1250). The alignment mechanism on the container (1250) positions the spout (400) at a predetermined location during the insertion of the pliable reservoir (822). Such a predetermined location may be near an opening of a port in which the bag-in-box print liquid supply is received. Putting the spout (400) at the front of the port allows for liquid supplies with different lengths to be inserted into the port easily by a user. For example, were the spout (400) near the back of a port, a user would have to extend their hand fully inside the port to insert a smaller liquid supply. As indicated in FIG. 16A the alignment mechanism is a channel (1656-3) that receives the spout (400) and slots (1656-1, 1656-2) to receive alignment protrusions (1658-1, 1658-2) of the clamp plate assembly (1034).

FIG. 16B illustrates the closure of the bag-in-box print liquid supply. Specifically, in some examples, the container (1250) includes a foldable opening through which the pliable reservoir (822) is inserted. Accordingly, once the spout (400), clamp plate assembly (1034), and reservoir (822) are fully inserted and properly aligned with the container (1250), the foldable opening may be closed and sealed. In this example, upon closing the first flange (FIG. 4, 404) and angled clamp flange (FIG. 4, 408) as well as the clamp plate assembly (1034) are enclosed within the container (1250).

Figure 18:
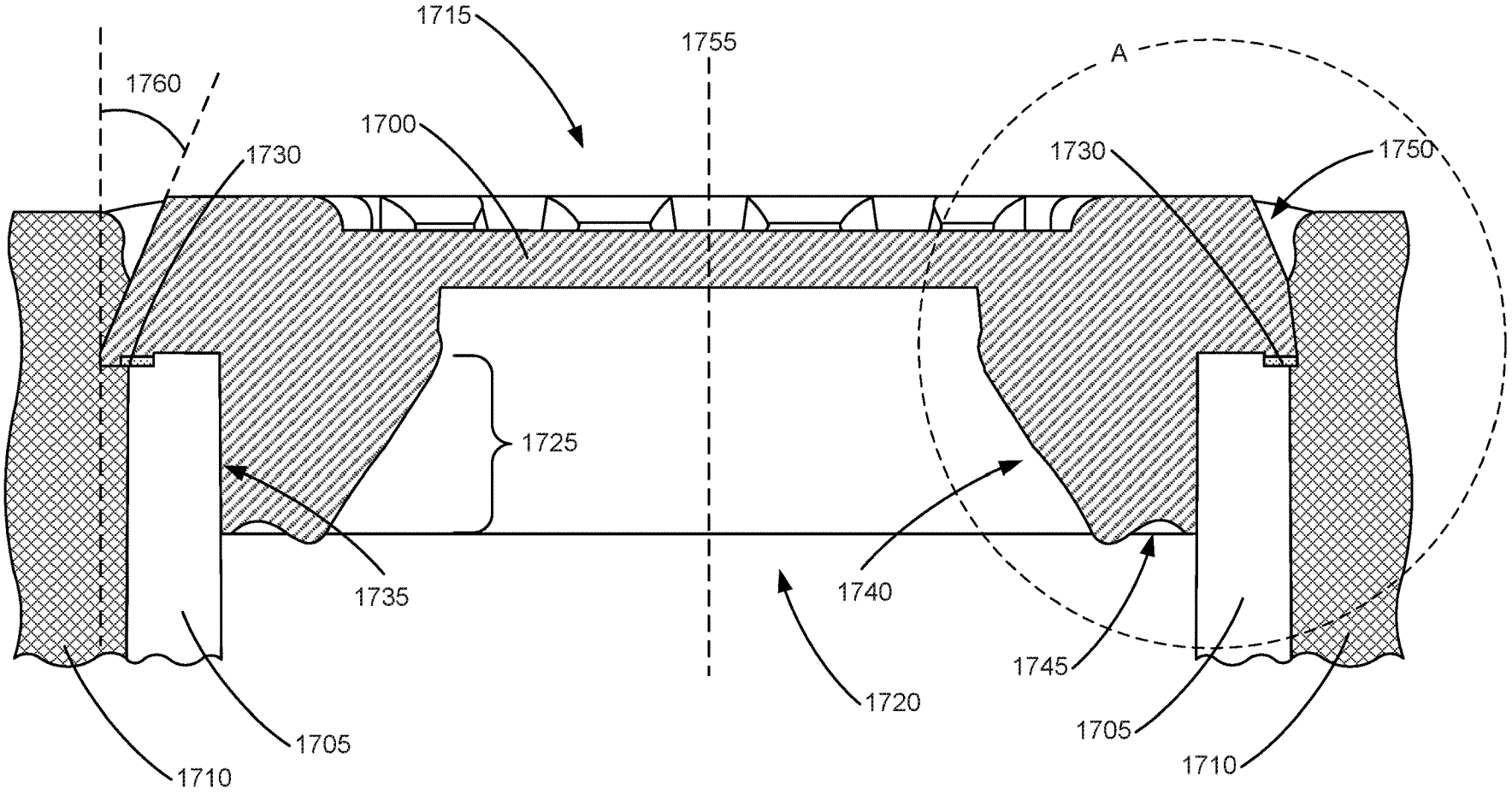
FIG. 18 is a side cut-out view of a collar according to an example of the principles described herein.

FIG. 18 is a side cut-out view of a collar (1700) according to an example of the principles described herein. FIG. 17 shows the collar (1700) is shown coupled to a fluidic channel (1705). In any of the examples presented herein, the fluidic channel (1705) may be formed within a fluidic interface as described herein. The fluidic channel (1705) and collar (1700), being coupled together, may be press fitted into a spout (1710) of a pliable fluidic container.

The collar (1700) includes a first surface (1715) and a second surface (1720). The first surface (1715) may be the surface that is exposed to an interior of the pliable fluidic container where a fluid is maintained. The second surface (1720) may be the surface that is exposed to an interior of the fluidic channel (1705).

The collar (1700) may, at the second surface (1720) include a barrel (1725). The barrel (1725) may have an exterior surface (1735). The exterior surface (1735) contacts an interior surface of the fluidic channel (1705) and prevents the translation of the collar (1305) horizontally relative to the fluidic channel (1705) as shown in FIG. 18. The collar (1700) further includes an interior surface (1740). In any of the examples presented herein, the interior surface (1740) of the second surface (1720) of the collar (1700) may include a gasket interface (1745). The gasket interface (1745) may, in any of the examples presented herein, interface with a gasket used within the fluidic channel (1705). In this example, the gasket may interface with a valve ball that prevents backflow into the pliable fluidic container. In an example, however, the collar (1305) may not include a gasket interface (1745) and instead may have the interior surface (1740) of the collar (1700) interface with the ball described. In an example, the collar (1700) may not interface with a ball.

In any of the examples presented herein, the collar (1305) may include a flash trap (1730). The flash trap (1730) may be used during a welding process as a location where melted portions of the collar (1700) and/or fluidic channel (1705) may be maintained. Again, the collar (1700) may be laser welded to the fluidic channel (1705). During the laser welding process, some portion of the collar (1700) and/or first end of the fluidic channel (1705) may be melted. These melted portions may flow out of the interface between the collar (1700) and the fluidic channel (1705). If left, the melted portions of the collar (1700) and/or fluidic channel (1705) may subsequently harden so as to create bulges and/or sharp protrusions out of the collar (1700)/fluidic channel (1705) sub-assembly. The bulges and/or sharp protrusions may damage the interior surface of the spout (1710) leading to an incomplete fluid barrier (100). To prevent the formation of the bulges and/or sharp protrusions, the collar (1700) may include the flash trap (1730) formed between the collar (1700) and the fluidic channel (1705). The flash trap (1730) may receive an amount of the melted material from the collar (1700) and/or fluidic channel (1705) therein during the laser beam welding process.

The first surface (1715) may include a tapered surface (1750). The tapered surface (1750) may have an angle (1760) of between 18-25 degrees relative to an axis (1755) of the collar (1700). During the laser welding process of the collar (1700) to the fluidic channel (1705), the angle (1760) of the tapered surface (1750) may refract the laser light through the transparent or semi-transparent material of the collar (1700) so as to direct the laser light to the interface between the collar (1700) and the fluidic channel (1705).

The laser light then melts an amount of material of either or both of the collar (1700) and fluidic channel (1705). The melted amount of material from either or both of the collar (1700) and fluidic channel (1705) may leak into the flash trap (1730) and be allowed to solidify. The flash trap (1730) thereby prevents an amount of melted material from leaking beyond the diameters of either the collar (1700) and/or fluidic channel (1705). The laser welding process may melt a layer of either or both of the collar (1700) and fluidic channel (1705) that is between 10-200 microns thick.

Figure 19:
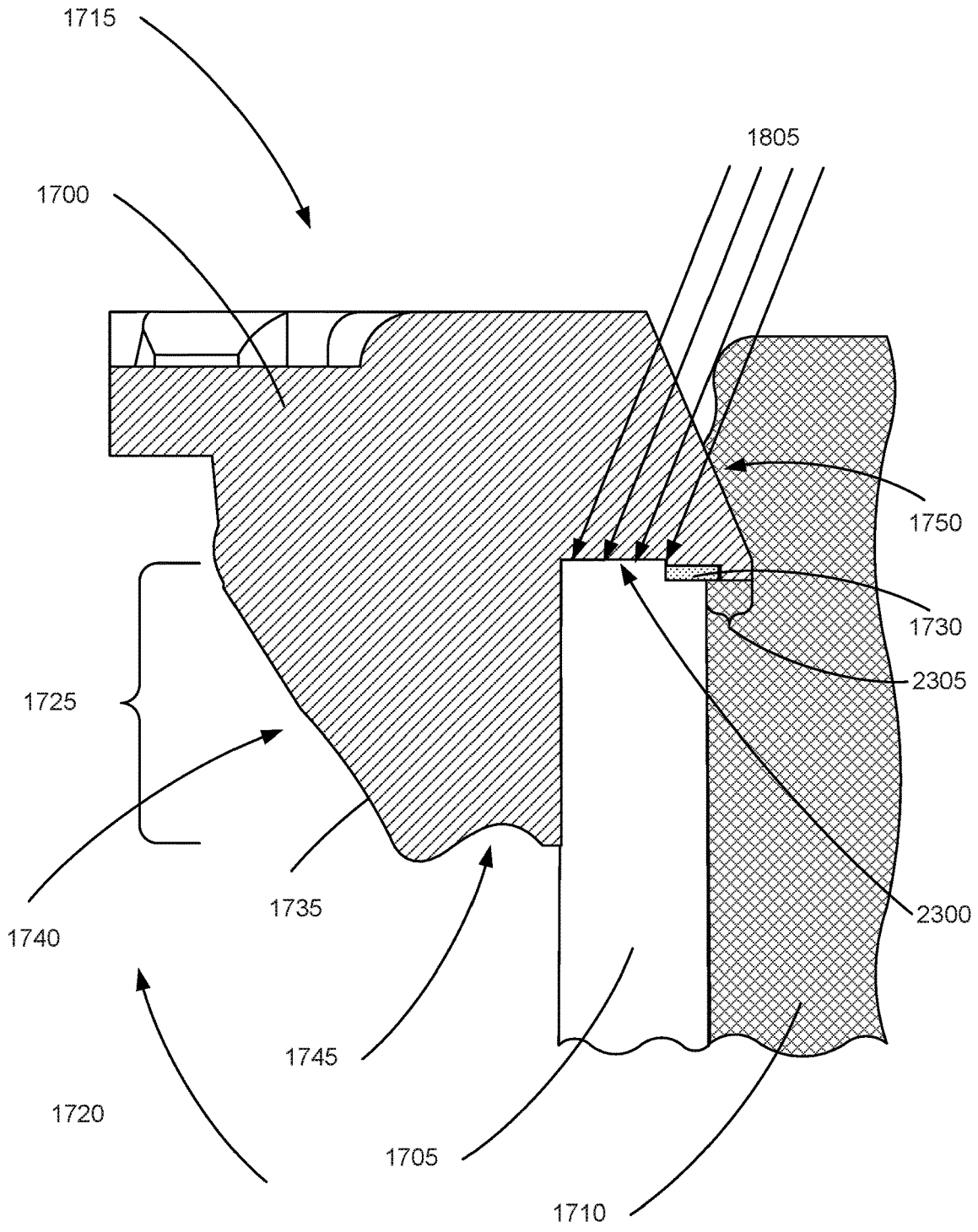
FIG. 19 is a side cut-out view of the collar of FIG. 18 according to an example of the principles described herein.

FIG. 19 is a side cut-out view of the collar of FIG. 17 according to an example of the principles described herein. During a laser welding process, laser light (1805) may be directed to the interface between the collar (1700) and fluidic channel (1705). The laser light (1805) may have a particular intensity and direction to melt the material of either or both the collar (1700) and fluidic channel (1705) as descried herein. The melted material is allowed to flow into the flash trap (1730) as described herein.

Figure 20:
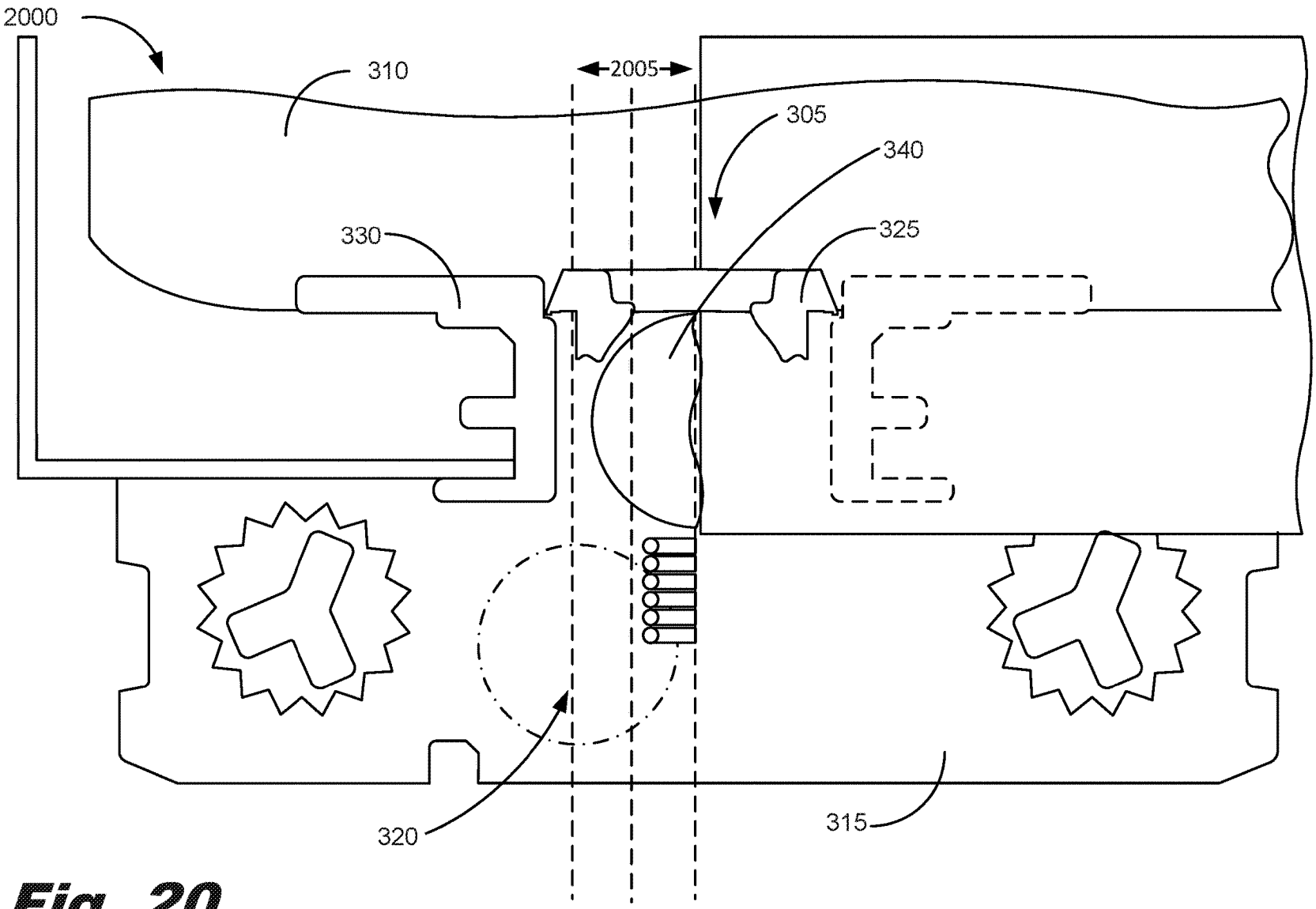
FIG. 20 is a side cutout view of a fluid interconnect according to an example of the principles described herein.

FIG. 20 is a side cutout view of a fluid interconnect (2000) according to an example of the principles described herein. The fluid interconnect (2000) shown in FIG. 20 shows the offset of the second fluidic channel (320) and first fluidic channel (305) depicted in FIG. 3. The first fluidic channel (305) extending from the pliable fluidic bag (310) to the fluid interconnect (2000) may be offset a distance (2005) from the second fluidic channel (320) extending from the first fluidic channel (305) the exterior of the fluid interconnect (2000). In an example, the distance (2005) is a radius of one of the first fluidic channel (305) and second fluidic channel (320). In an example, the distance (2005) is a diameter of one of the first fluidic channel (305) and second fluidic channel (320). In an example, the distance (2005) is offset from a center line of the fluid interconnect (2000). In an example, the offset between the first fluidic channel (305) and second fluidic channel (320) is equal to the sum of the radii of each of the first fluidic channel (305) and second fluidic channels (320). In these examples, the distance (2005) is one of a diameter of either the first fluidic channel (305) and second fluidic channel (320) or a radius of either the first fluidic channel (305) and second fluidic channel (320). In any of the examples explained herein, a fluidic window between the first fluidic channel (305) and second fluidic channel (320) may be formed allowing fluid to flow from the first fluidic channel (305) to the second fluidic channel (320).

The specification and figures describe a print liquid supply sub-assembly, a replaceable printing fluid supply, and a bag-in-box printing fluid supply. The supplies include a valve the prevents backflow of fluid into a pliable fluidic bag fluidically coupled to the fluidic interface and/or a valve to prevent fluid from exiting the supply. Preventing backflow into the pliable fluidic bag prevents the introduction of air the first fluidic channel and/or second fluidic channel thereby reducing the chance of air being introduced into a printing system using the fluid supply described herein. Preventing the fluid form exiting the supply prevents leakage of the fluid prior to interfacing the supply with a printing device. The manufacture of the fluid supply described herein provides for a relatively lower manufacturing cost for the fluid supply. The orientation of the fluidic channels described herein provide for a layout of the channels within the fluidic interface that provides for a forward oriented fluidic interface on the fluid supply when coupled to the printing device interface. Having the two valves in the two fluidic channels as described within the fluidic interface, allows for a single interface to control the output and maintenance of the fluid within the fluid supply.

The preceding description has been presented to illustrate and describe examples of the principles described. This description is not intended to be exhaustive or to limit these principles to any precise form disclosed. Many modifications and variations are possible in light of the above teaching.

What is claimed is:

1. A print liquid supply sub-assembly for a print cartridge, the print liquid supply sub-assembly to connect to a printer to provide a print liquid to the printer, the print liquid supply sub-assembly comprising:

a print liquid output to connect to a print liquid input of the printer;

a first fluidic channel upstream of the print liquid output, the first fluidic channel including a first fluidic valve to prevent the print liquid from entering a supply container upstream of the first fluidic valve; and a second fluidic channel upstream of the print liquid output fluidically coupled to the first fluidic channel, the second fluidic channel including a second fluidic valve to selectively prevent the fluid from passing out of the supply container downstream from the second fluidic valve, the second fluidic channel and second fluidic valve extending downstream of the first fluidic channel and the first fluidic valve, a portion of the first fluidic channel including the first valve perpendicular to a portion of the second fluidic channel including the second valve, the second fluidic channel offset from the first fluidic channel, the offset of the second fluidic channel is a horizontal offset.

2. The sub-assembly according to claim 1, wherein the first fluidic valve includes a check valve ball and a seal to prevent flow of fluid past the check valve ball and into the supply container.

3. The sub-assembly of claim 2, wherein the first fluidic valve includes a spring to force the check valve ball against the seal.

4. The sub-assembly according to claim 2, wherein the check valve ball is a first check valve ball, the second fluidic valve including a second check valve ball and septum to prevent the fluid from passing out of the supply container downstream from the second fluidic valve.

5. The sub-assembly of claim 4, wherein the second fluidic valve includes a spring to force the second check valve ball against a selectively closable hole formed in the septum.

6. The sub-assembly according to claim 1, wherein an interface between the first fluidic channel and second fluidic channel is located at a distance along an off-center length of the second fluid channel.

7. A print liquid supply sub-assembly to connect to a printer to provide a print liquid to the printer, the print liquid sub-assembly comprising:

a print liquid output to connect to a print liquid input of the printer;

a first fluidic channel upstream of the print liquid output, the first fluidic channel including a first fluidic valve to prevent the print liquid from entering a supply container upstream of the first fluidic valve; and a second fluidic channel upstream of the print liquid output fluidically coupled to the first fluidic channel, the second fluidic channel including:

a second fluidic valve to selectively prevent the fluid from passing out of the supply container downstream from the second fluidic valve;

a number of ribs through which a fluid may flow past a check valve ball when the check valve ball is pushed into the second fluidic channel by a fluid needle.

8. The print liquid supply sub-assembly of claim 7, wherein the second fluidic channel and second fluidic valve extends downstream of the first fluidic channel and first fluidic valve.

9. The sub-assembly according to claim 7, wherein the first fluidic channel and second fluidic channel are at an angle with respect to one another.

10. The sub-assembly according to claim 7, wherein the first fluidic channel and second fluidic channel are perpendicular with respect to one another.

11. The sub-assembly according to claim 7, wherein the second fluidic channel is offset from the first fluidic channel.

12. The sub-assembly of claim 11, wherein the offset of the second fluidic channel is a horizontal offset.

13. A print liquid supply sub-assembly to connect to a printer to provide a print liquid to the printer, the print liquid supply sub-assembly comprising:

a print liquid output to connect to a print liquid input of the printer;

a first fluidic channel upstream of the print liquid output, the first fluidic channel including a first fluidic valve to prevent the print liquid from entering a supply container upstream of the first fluidic valve; and a second fluidic channel upstream of the print liquid output fluidically coupled to the first fluidic channel, the second fluidic channel including a second fluidic valve to selectively prevent the fluid from passing out of the supply container downstream from the second fluidic valve, the second fluidic channel offset from the first fluidic channel, the offset of the second fluidic channel is a horizontal offset, and the horizontal offset of the second fluidic channel is equal to the sum of the cross-sectional radii of both of the first and second fluidic channels.

14. A replaceable printing fluid supply comprising:

a container to hold a volume of printing fluid; and a fluidic interface including a first fluidic channel fluidically coupled to the container by a second fluidic channel, the first fluidic channel including a fluidic valve to selectively prevent the printing fluid from passing out of the container downstream from the fluidic valve, the first fluidic channel and the second fluidic channel offset from a horizontal middle of the fluidic interface, the second fluidic channel offset from the first fluidic channel horizontally, the horizontal offset of the second fluidic channel is equal to the sum of the cross-sectional radii of both of the first and second fluidic channels.

15. The replaceable printing fluid supply according to claim 14, wherein the first fluidic channel includes a septum and wherein the fluidic valve includes a spring and ball, the spring to force the ball against a resealable hole formed in the septum.

16. The replacement printing fluid supply of claim 15, wherein a surface of the septum between the ball and the septum is concave.

17. A replaceable printing fluid supply comprising:

a container to hold a volume of printing fluid; and a fluidic interface including a first fluidic channel fluidically coupled to the container by a second fluidic channel, the first fluidic channel including a first fluidic valve to selectively prevent the printing fluid from passing out of the container downstream from the first fluidic valve, the first fluidic channel and the second fluidic channel offset from a horizontal middle of the fluidic interface, the offset of the first fluidic channel and second fluidic channel from the middle of the fluidic interface is equal to the sum of the radii of each of the channels.

18. A replaceable printing fluid supply comprising:

a container to hold a volume of printing fluid; and a fluidic interface including a first fluidic channel fluidically coupled to the container by a second fluidic channel, the first fluidic channel including a fluidic valve to selectively prevent the printing fluid from passing out of the container downstream from the fluidic valve, the first fluidic channel and the second fluidic channel offset from a horizontal middle of the fluidic interface, and the second fluidic channel including a second fluidic value, the second fluidic valve including ball to prevent backflow into the container when the ball is forced into a collar formed on a proximal end of the first fluidic channel closet to the container.

19. The replaceable printing fluid supply of claim 18, wherein the first fluidic channel and second fluidic channel are offset from each other.

20. The replaceable printing fluid supply of claim 19, wherein the offset of the second fluidic channel is a horizontal offset.

21. The replaceable printing fluid supply of claim 18, wherein the second fluidic valve includes a spring to force the ball into the collar.

22. The replaceable printing fluid supply of claim 21, further including a gasket intermediate to the collar and ball to selectively seal the fluid in the second fluidic valve.

* * * * *